United States Patent [19]

Gomi et al.

[11] 4,456,393

[45] Jun. 26, 1984

[54] WIRE DOT PRINTER

[75] Inventors: Yoshifumi Gomi; Masanao Matsuzawa; Yoshito Ikeda; Yoshihisa Morita, all of Shiojiri, Japan

[73] Assignee: Kabushiki Kaisha Suwa Seikosha & Epson Corporation, Tokyo, Japan

[21] Appl. No.: 274,322

[22] Filed: Jun. 16, 1981

[30] Foreign Application Priority Data

| | | | |
|---|---|---|---|
| Jun. 17, 1980 | [JP] | Japan | 55-8109 |
| Aug. 6, 1980 | [JP] | Japan | 55-107881 |
| Sep. 29, 1980 | [JP] | Japan | 55-135621 |
| Oct. 29, 1980 | [JP] | Japan | 55-151726 |
| Dec. 22, 1980 | [JP] | Japan | 55-181684 |
| Jan. 26, 1981 | [JP] | Japan | 56-9533[U] |

[51] Int. Cl.[3] ..... B41J 3/12; B41J 27/20

[52] U.S. Cl. ..... 400/124; 400/470

[58] Field of Search ..... 400/124, 470

[56] References Cited

U.S. PATENT DOCUMENTS

| | | | |
|---|---|---|---|
| 3,739,717 | 6/1973 | Brown et al. | 101/366 X |
| 4,109,483 | 8/1978 | Mitter | 68/200 |
| 4,112,531 | 9/1978 | Mitter | 8/149 |
| 4,131,000 | 12/1978 | Mitter | 68/200 |
| 4,155,229 | 5/1979 | Mitter | 68/200 |
| 4,194,846 | 3/1980 | Zerillo | 400/124 |
| 4,261,285 | 4/1981 | Pearl | 118/37 |
| 4,279,519 | 7/1981 | Shiurila | 400/124 |

FOREIGN PATENT DOCUMENTS

| | | | |
|---|---|---|---|
| 2152241 | 4/1973 | Fed. Rep. of Germany | 400/124 |
| 2546835 | 4/1977 | Fed. Rep. of Germany | 400/124 |
| 32740 | 3/1978 | Japan | 400/470 |
| 13180 | 2/1981 | Japan | 400/124 |
| 86772 | 7/1981 | Japan | 400/470 |

OTHER PUBLICATIONS

IBM Technical Disclosure Bulletin, vol. 14, No. 10, Mar. 1972, p. 2980 J. E. Lisinski.

IBM T.D.B., vol. 22, No. 12, May 1980, p. 5303, "Flexible Cable" E. Hungarter.

IBM T.D.B., vol. 22, No. 8B, Jan. 1980, p. 3530, "Method for Making Print Wires" R. Travieso.

Nowselski, "Self Contained Inking and Print Wire" IBM Technical Disclosure Bulletin, vol. 23, No. 4, pp. 1347–1350, 9/80.

Lisinski et al. "Self Inking Printing Wires" IBM Technical Disclosure Bulletin, vol. 14, No. 9, p. 285, 2/72.

Ribbonless Impact Printer, IBM Tech. Disclosure, vol. 14, No. 3, (Aug. 1971).

Ribbonless Ink Printer, IBM Tech. Disclosure, vol. 16, No. 1, (Jun. 1973).

*Primary Examiner*—William Pieprz

*Attorney, Agent, or Firm*—Blum, Kaplan, Friedman, Silberman & Beran

[57] ABSTRACT

A wire dot printer using fluid ink in which printing is carried out with the ink adhering to the end faces of the wires. A front wire guide guides the end portions of the wires adjacent to the printing end faces of the wires. A rear wire guide is positioned behind the front wire guide. An ink path fed by capillary action is provided between the front and rear wire guides which crosses the wires at positions adjacent the end faces of the wires. Also disclosed is a pump for conveying the ink within the printer and preferred compositions of the ink itself.

67 Claims, 37 Drawing Figures

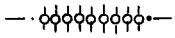
FIG. 1B
PRIOR ART
FIG. 1A
PRIOR ART
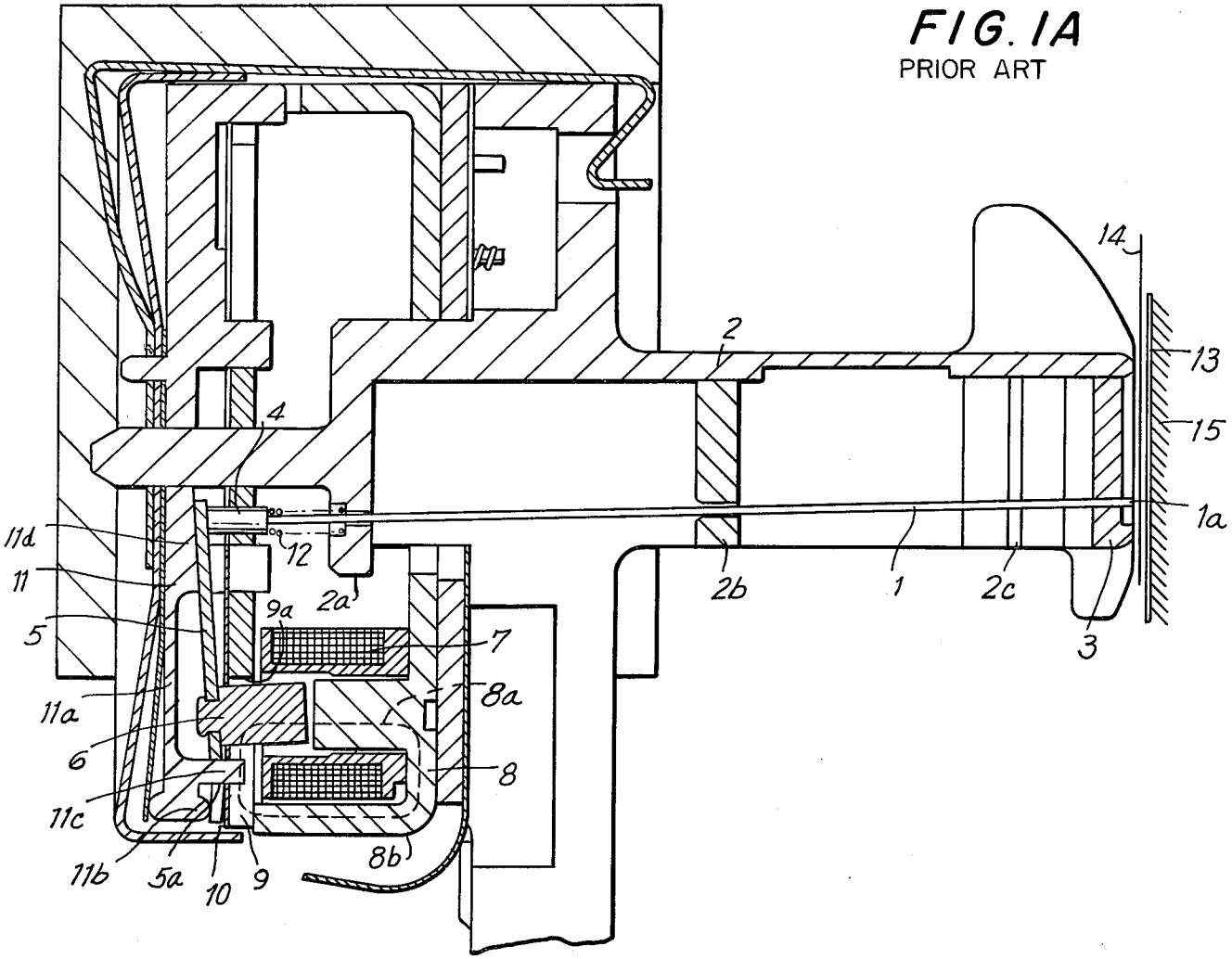

FIG. 3D
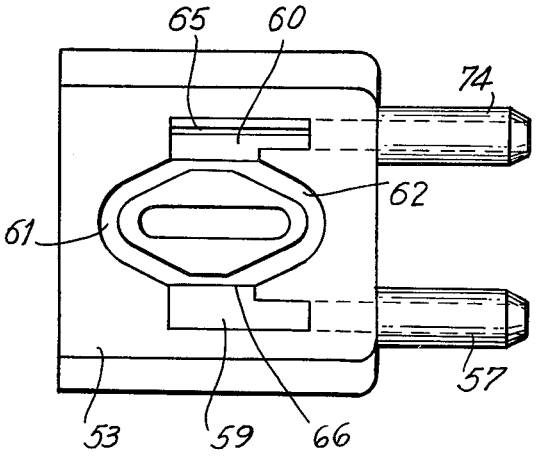
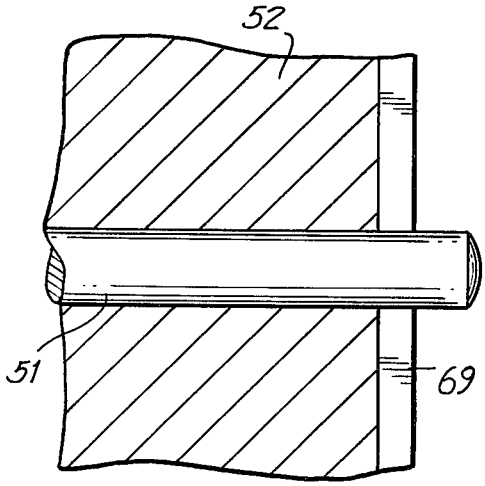
FIG. 3E

FIG. 10A
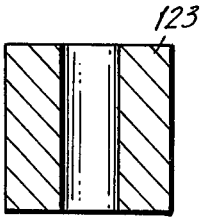
FIG. 10B
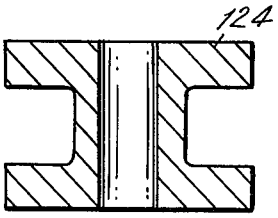
FIG. 11A
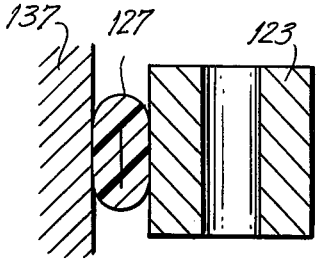
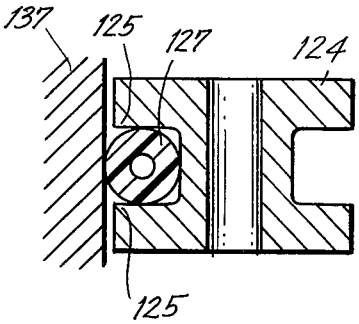
FIG. 11B
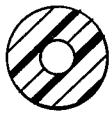
FIG. 12A
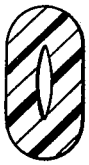
FIG. 12B FIG. 13
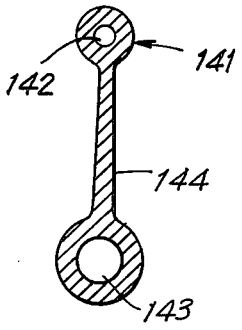
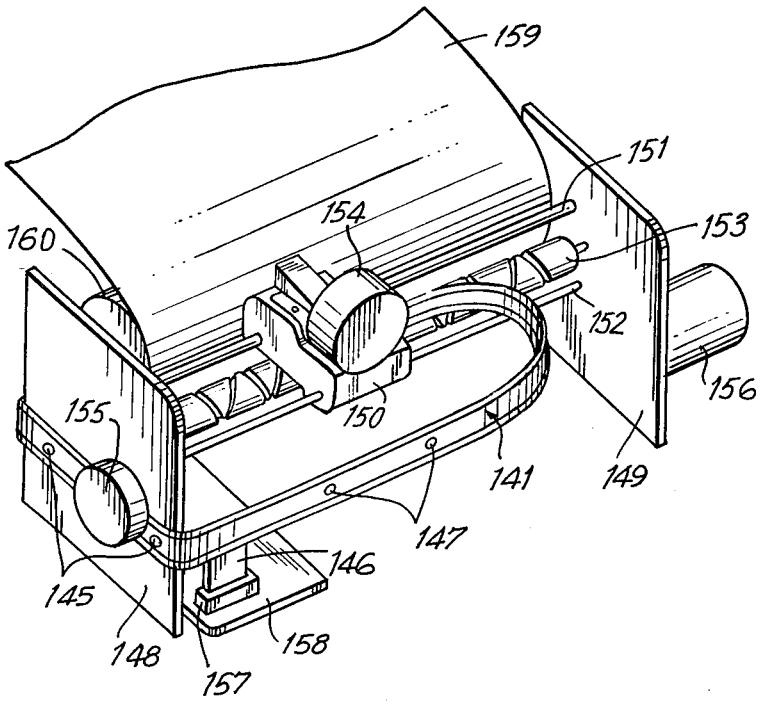
FIG. 14

WIRE DOT PRINTER

BACKGROUND OF THE INVENTION

The present invention relates to wire dot printers, and more particularly to a wire dot printer in which printing is carried out with ink on printing end faces of wires.

A variety of wire dot printers have been extensively employed, almost all of which use ink ribbons. Wire dot printers have been extensively employed, and are advantageous in the following points. The degree of freedom in formation of characters is considerably high; that is, any character or figure can be printed as desired. In addition, characters can be printed as desired with a limited number of dots. Therefore a wire dot printer can carry out printing operations at higher speeds than a matrix type printer. Furthermore, the wire dot printer is advantageous in that a plurality of sheets can be printed simultaneously.

A wire dot printer using an ink ribbon however, has drawbacks in that, since printing is made through the ink ribbon, the resultant prints are not sharp, and since the ink ribbon is struck by the wires, the service life of the ink ribbon is not as long as is desirable. Moreover, if the diameter of the wires is made exceedingly small, because of the great impact stress then imposed on the ribbon, the durability of the ribbon is considerably decreased. In addition to this, it is difficult to make the texture of an ink ribbon as tight as is desirable due to limitations of present cloth weaving techniques. For these reasons, the minimum diameter of wires employed in a wire dot printer using an ink ribbon is limited. That is, it is impossible to use wires of very small diameter with the wire dot printer. Furthermore, it is necessary to provide an additional ink ribbon mechanism for holding and transporting the ink ribbon. This makes the printer intricate and makes it difficult to miniaturize the printer.

The wire dot printer has further disadvantages in the following points. After the wires have been used for a certain period of time, the end faces of the wires tend to become blunt. If the wires have hardened peripheral portions, the print faces of the wires become recessed as they wear. As a result, the stress in striking the ink ribbon is increased until finally the ink ribbon breaks. The length of the ribbon is limited which also limits the service life of the ribbon. Thus, it is difficult to use the same ribbon for a long period of time. Also, in the printer, the mounting position for the ribbon feeding mechanism is limited. Therefore, disadvantageously, the printer is necessarily bulky.

For a multi-pin printer, attempts have been made to decrease the size of characters to be printed. This necessitates an increase in printing density per unit linear distance to provide an acceptable print quality.

In order to fully utilize an advantage of the wire dot printer, namely, a plurality of sheets can be printed simultaneously it is necessary to use a printing force higher than a certain value. Accordingly, if small diameter wires are used, the stress generated upon striking the ribbon with the wires is very high and therefore the ribbon is liable to be broken. On the other hand, in the case of the ink ribbon used in a conventional multi-pin printer, it is impossible to make the texture of the ink ribbon as tight as would otherwise be desirable using presently-available cloth weaving techniques. If the wire diameter is small compared with the texture, then the wire tends to penetrate the ink ribbon as a result of which the wire may be broken. Because of these difficulties, the minimum diameter of the wire is about 0.2 mm where an ink ribbon is used. Accordingly, it is difficult to make imprints having a small line width, high density and high quality. Thus, the quality of print is limited by the wire diameter.

A variety of non-impact printers using no ink ribbon have been proposed in the art. However, such printers suffer from a drawback that a plurality of sheets cannot be printed simultaneously. This is a distinct disadvantage.

Techniques of applying ink to the print end faces of the printing wires without using an ink ribbon have been proposed in the art, for instance, in Japanese Published Application No. 19251/1966, U.S. Application Ser. No. 320 762, U.S. Pat. No. 4,194,846, and German Patent No. 2,546,835. None of these techniques, however, has been found totally satisfactory in that it is difficult to apply a suitable quantity of ink stably and positively to the print end faces of the wires following high-speed repetitive motion of the wire thereby to print sharply and with high quality.

For example, the system disclosed in U.S. Patent No. 4,194,846, uses a wick material impregnated with ink through which wires run so that top ends (impact faces) of the wires carry ink onto a paper sheet to form a dot pattern. With this technique, it is very difficult to ensure the provision of ink uniformly on each of the top ends of the wires reciprocating at high speed due to a capillary phenomenon in the wick material thereby resulting in non-uniform printing. Further, the wick material tends to clog.

In accordance with German Patent No. 2,546,835, ink from an ink tank disposed below the wires is supplied by capillary action to the wires. With this arrangement, the amount of ink supplied is restricted and thus, the ink supply cannot follow high speed reciprocal operation of the wires causing the printing speed to be limited. Further, there are condensation problems with the ink.

SUMMARY OF THE INVENTION

Generally speaking, in accordance with the invention, there is provided a wire dot printer using fluid ink in which printing is carried out with ink adhering to the end faces of the printing wires. The printer includes the printing wires, a front wire guide adapted to guide end portions of the wires, a rear wire guide positioned behind the front wire guide, and means for providing an ink path which crosses the wires at positions adjacent the end faces of the wires with these positions being between the front wire guide and the rear wire guide.

The invention may further be practiced by a wire dot printer using a fluid ink in which printing is carried out with ink adhering to the end faces of the wires, and including a front wire guide adapted to guide end portions of the wires from positions adjacent the printing end faces of the wires, and a rear wire guide confronting the front wire guide. The printer also includes means for forming an ink path for providing a capillary force with the ink path being formed by the front wire guide and the rear wire guide in such a manner that the ink path corsses the paths of the wires. Also included are an ink recovering plate forming a capillary path with the rear wire guide, a space provided between the ink recovering plate and the rear wire guide which become larger rearwardly of the wires, an ink supplying port for supplying ink to the ink path, and an ink discharging port for discharging surplus ink supplied through the ink supplying port with the ink path. The space, the capillary path and the ink discharging path communicate with one another.

Yet further, the invention encompasses a wire dot printer using a fluid ink which has an inking mechanism in which printing is carried out with the ink adhering to the printing end faces of the wires, and including a front wire guide adapted to guide end portions of the wires adjacent the printing end faces of the wires, a rear wire guide provided behind the front wire guide with the front wire guide and the rear wire guide forming an ink path crossing the wires, an inking mechanism for supplying ink to the printing end faces, an ink supplying port for supplying ink to the inking mechanism, an ink discharging port for discharging surplus ink supplied through the ink supplying port, and a pump. The ink is supplied through the ink supplying port by the pump and discharged through the ink discharging port by the pump. The pump preferably includes a central shaft, a rotary plate rotatable around the central shaft, a plurality of rollers rotatably supported on a circumference of the rotary plate with this circumference being coaxial with the central shaft, a housing having arcuate guides along the locus of revolution of the rollers, and an ink supplying elastic tube and an ink discharging elastic tube, with the elastic tubes being disposed between the housing and the rollers. The ink supplying tube and the ink discharging tube along with a belt-shaped support can be formed as a single unit.

The ink preferably includes at least 20 percent of a wetting agent by weight under a saturated vapor pressure of not more than 0.1 mm Hg at room temperature with coloring matter being dissolved in the wetting agent. The fluid ink preferably has a pH of at least 7. Moreover, the wetting agent preferably has a viscosity of not more than 50 c.p. at room temperature and the ink preferably has a viscosity of not more than 10 c.p. at room temperature as described herein. Also, the ink may contain a bubble suppressing agent.

Accordingly, an object of the present invention is to provide an improved wire dot printer in which, even if the wires of the printer head are repeatedly operated at high speed, a suitable quantity of ink is reliably and positively supplied to the print end face of each wire.

Furthermore, the invention is intended to provide an inking mechanism which can reliably supply ink to the print end faces of wires thereby to provide a wire dot printer in which the range of use of the wires is increased such that wires of very small diameter, which cannot be used in a wire dot printer using an ink ribbon, can be effectively used, and in which printing can be carried out with a high printing density while providing high printing quality.

Another object of the invention is to provide an improved wire dot printer in which ink is reliably and positively provided at the printing end faces of the wires thereby to eliminate the need for an ink ribbon. With use of this invention, the above-described drawbacks concerning durability of the ink ribbon, limitation of wire diameters, and life of the ink ribbon when using an ink ribbon, are eliminated, whereby the reliability of the printer is greatly improved.

Accordingly, the invention is further intended to provide an improved inking mechanism in which no ink ribbon is used, and instead ink is reliably and positively supplied directly to the printing end faces of the wires, thereby solving the above-described various problems which arise when an ink ribbon is used.

Another object of the invention is to provide an improved inking mechanism in which a suitable quantity of ink is supplied positively to the printing end faces of the wires following highspeed repetitive motion of the wires.

The invention further relates to a pump employed in a wire dot printer using fluid ink. This desired pump has a valve action which obstructs the flow of ink when its operation is stopped. More specifically, it is preferable to employ a peristaltic pump which includes a rotary plate rotating around a central shaft, a plurality of rollers which are rotatably mounted on shafts arranged on the rotary plate coaxially with the central shaft, a housing with arcuate guides extending along the locus of revolution of the rollers, and elastic tubes inserted between the rollers and the housing, so that the fluid is pumped by alternately depressing and relieving the tubes with the rollers. The peristaltic pump thus constructed is used to supply ink to a printer head and to discharge surplus amounts of ink therefrom, whereby a predetermined amount of ink is reliably maintained in the inking mechanism of the printer head to make satisfactory dot prints on the printing sheet.

A peristaltic pump alternately, when operating, depresses and relieves elastic tubes with a plurality of rollers which are revolved and rotated simultaneously thereby to perform a pumping action by the utilization of the restoring forces of the elastic tubes. This type of pump is advantageous in that no priming is required, it can be used with a variety of fluids such as liquids, gases, fine slurry fluids, and highly-viscous fluids, and it is suitable for delivering fluid at a low flow rate.

However, the peristaltic pump is disadvantageous in the following points. If the elastic tube is insufficiently depressed, the elastic tube will not completely close and accordingly the fluid cannot be delivered. If, on the other hand, the elastic tube is excessively depressed, the stress on the elastic tube is increased and the elastic tube can be worn out in a short time. As a result, the restoring force of the elastic tube is decreased so that the pumping action is not satisfactorily performed, and at worst the elastic tube is broken.

Thus, the amount of depression of the elastic tube should be set to a suitable value in order to permit the pump to carry out a satisfactory pumping operation. For this purpose, it is necessary to arrange the rollers along a circumference coaxial with the central shaft so that they revolve and rotate simultaneously, and it is also necessary that the arcuate guides disposed along the rollers be equally spaced from the central shaft. However, because of errors involved in machining, it is difficult to arrange the arcuate guides so that they are equally spaced from the central shaft and it is also difficult to set the amount of depression of the elastic tube to a suitable value.

In order to eliminate these difficulties, a construction has been proposed previously wherein shafts for rotatably supporting rollers are provided on the circumference on a rotary plate which is driven by a driving shaft. The circumference is coaxial with the driving shaft, the rollers are rotatably mounted on the shafts thus arranged, and spacers such as bearings are provided between the driving shaft and the rollers in contact with the driving shaft and the rollers, whereby the distances between the center of the driving shaft and the contact points of the rollers where the rollers come into contact with the elastic tube are made equal to one another. However, even using this method, the fluctuations in dimensional accuracy of the elastic tube itself cannot be absorbed. Thus, the construction suffers still from the above-described drawback that if the wall thickness of the elastic tube is small, the elastic tube will not be sufficiently depressed, and if the wall thickness is large, the elastic tube is excessively depressed.

According to experiments conducted by the inventors, silicone tubes usually employed as the elastic tubes have manufacturing variations of about 20% in wall thickness. Accordingly, it is difficult with the conventional method to suitably set the depression distance due to the variations in wall thickness.

Furthermore, if an annular case is employed, the presence of the elastic tube disturbs the operation of mounting the rollers on the shafts. The rollers cannot be mounted on the shafts without moving (turning) each shaft to a position where no elastic tube is located. Thus, the conventional method is disadvantageous also in that it is necessary to turn the shaft as many times as the number of rollers to mount the rollers on the shafts making it rather troublesome to assemble the pump.

Accordingly, the subject invention is intended to provide a peristaltic pump in which all of the above-described disadvantages have been eliminated, and even if elastic tubes are used which are variable in dimensional accuracy or the dimensions of various other components are variable due to machining inaccuracies, the amount of depression of the elastic tubes is suitably maintained to carry out satisfactory pumping operations.

An additional object of the invention is to provide a peristaltic pump which can be readily assembled and in which the elastic tubes can be readily replaced.

A particular object of the invention is to provide a peristaltic pump in which the durability of the elastic tubes is improved.

Still other objects and advantages of the invention will in part be obvious and will in part be apparent from the specification.

The invention accordingly comprises the features of construction, combination of elements, and arrangement of parts which will be exemplified in the constructions hereinafter set forth, and the scope of the invention will be indicated in the claims.

BRIEF DESCRIPTION OF THE DRAWINGS

For a fuller understanding of the invention, reference is had to the following description taken in connection with the accompanying drawings, in which:

FIG. 1A is a sectional side view of a wire dot printer and FIG. 1B shows a front array of wires in the printer;

FIGS. 3A–3E is an embodiment of an inking mechanism according to the invention in which FIG. 3A is a sectional view of the inking mechanism as viewed from above the dot print head; FIG. 3B is the inking mechanism as viewed from the printing end faces of the wires; FIG. 3C is a side sectional view of the inking mechanism; FIG. 3D is the components of a wire rear guide, and FIG. 3E is a diagram showing a wire in position of impact;

FIGS. 4A–4E are sectional views of another embodiment of an inking mechanism in which grooves are cut in an ink path, of which FIG. 4B is a diagram showing the structure of a rear wire guide in the inking mechanism; FIG. 4C is a plan view of a wire guide as viewed from the side of the ink path; FIG. 4D is a plan view of an alternative wire guide as viewed from the side of the ink path, and FIG. 4E is a diagram showing the components of yet another embodiment of a wire rear guide;

FIGS. 10A and 10B are sectional views showing rollers in an alternative embodiment of a peristaltic pump;

FIGS. 11A and 11B are diagrams of the operations of the rollers shown in FIG. 10A and 10B respectively;

FIGS. 12A and 12B are sectional views of a new elastic tube and an old elastic tube respectively;

FIG. 13 is a sectional view of a belt-shaped ink supplying tube unit in accordance with the invention;

FIG. 14 is a perspective view of a wire dot printer using fluid ink and equipped with the belt-shaped ink supplying tube unit shown in FIG. 13;

DESCRIPTION OF THE PREFERRED EMBODIMENTS

Figure 2A:
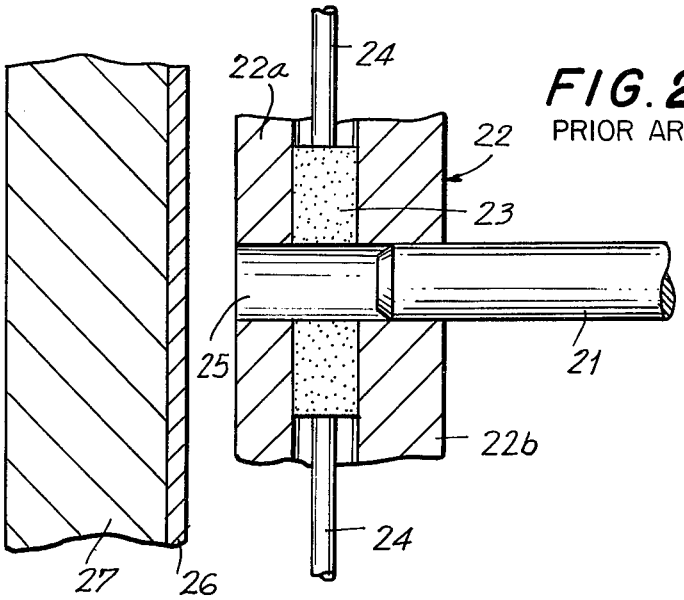
FIG. 2A PRIOR ART
FIG. 2A is a partial sectional view of an inking mechanism to an enlarged scale showing a wire in a standby state and FIG. 2B shows the wire which has been driven.

First, for convenience in description, the sectional view of FIG. 1A illustrating the principles of a wire dot printer is described.

In FIG. 1A, a wire 1 has a printing end face 1*a* and a wire pin 4 which is fixedly secured to the wire 1 so as to engage with an operating plate 5. A nose piece 2 receives the wire 1 and includes guides 2*a*, 2*b* and 2*c* for guiding a plurality of wires 1 in a predetermined pattern and configuration, and an end guide 3 for guiding the end portions of the wires. In the construction of FIG. 1A, the arrangement of the end portions of the wires 1 is such that, as shown in FIG. 1B, nine wires are arranged in one line.

The dot printer includes a plunger 6 fixedly secured to the operating plate 5, a drive coil 7, a frame 8 of magnetic material in which a coil core 8*a* for attracting the plunger 6 when the drive coil 7 is excited, and a cylindrical yoke 8 formed in the peripheral portion where a plurality of drive coils are arranged, a yoke plate 9 of magnetic material in which is formed a hole 9*a* through which the plunger 6 passes, a spacer 10, and an operating plate retaining plate 11. The operating plate retaining plate 11 has elastic arms 11*a* which are arranged in the form of flower petals wherein a plurality of operating plates 5 arranged in a circle are mounted on independent fulcrums. A protrusion 11*b* for retaining the operating plate 5 and a protrusion 11*c* for engaging with an operating plate guiding hole 5*a* formed at the fulcrum of the operating plate 5 are provided at the end of each elastic arm 11*a*. In addition, the elastic arm 11*a* has a striking part 11*d* for determining the standby position of the operating plate 5. The operating plate 5 is bent as illustrated so that, when it is depressed by the elastic arm 11*a* near the fulcrum, a restoring force which depresses the operating plate against the striking part 11*d* is generated at the end of the operating plate 5 where it is engaged with the wire pin 4.

Referring to FIG. 1 again, the wire dot printer includes a wire returning spring 12 for pushing the wire 4 and the operating plate 5 toward the standby position, an ink ribbon 14, a recording sheet 12, and a platen 15.

Operation of the wire type printer thus constructed will be briefly described.

When the drive coil 7 is energized in response to an external control signal, a magnetic flux is generated, as indicated by a broken line, which attracts the plunger 6 which is fixedly secured to the operating plate 5. As a result, the operating plate 5 pivots around the fulcrum pushing the wire pin 4 engaged with the end portion and the wire 1 in the printing direction. The wire thus pushed strikes the platen 15 through the ink ribbon 14 and the recording sheet 13 to print a dot on the latter. That is, in this operation, ink impregnated in the ink ribbon 14 is transferred to the recording sheet 13. Then, the wire 1 is returned to the standby position by the wire returning spring 12 and is held there until the next printing signal is received. The drawbacks accompanying this type of dot printer using an ink ribbon have been described above.

An example of an earlier device in which no ink ribbon is used and ink is directly adhered to the wire ends is now described with reference to FIGS. 2A and 2B.

Figure 2B:
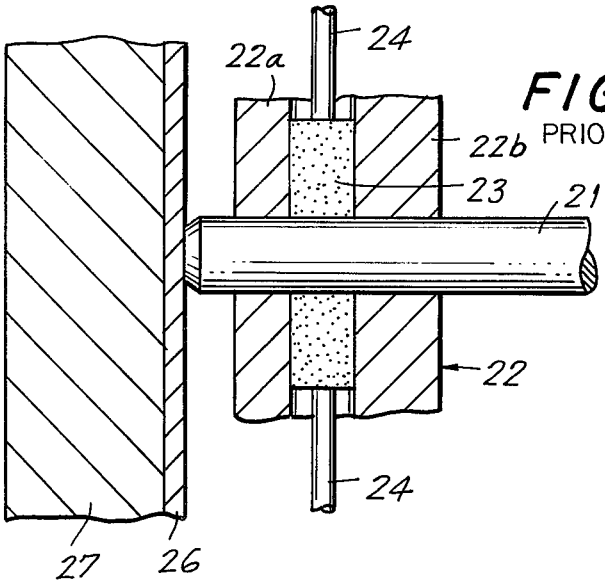
FIG. 2B PRIOR ART

FIGS. 2A and 2B show only an inking mechanism for the end of a wire dot head. More specifically, FIG. 2A shows a wire 21 in a standby state and FIG. 2B shows the wire 21 when it is driven. In FIG. 2A, the wire dot head includes the wire 21, a wire end guide 22 comprised of a front guide 22*a* and a rear guide 22*b* between which an ink impregnated material 23 is arranged with ink supplied through an ink supplying pipe 24 to the ink impregnated material 23, a wire hole 25 through which the wire 21 passes, a recording sheet 26, and a platen 27.

The wire 21 is slidably inserted in the wire end guide 22. That is, the wire end guide 22 is so designed that, when the wire 21 is operated, the ink impregnated material 23 is brought into contact with the sliding surface of the end portion of the wire 21. In the printing standy state, as shown in FIG. 2A, the wire 21 is maintained retracted from the position of the ink impregnated material 23. When the wire 21 is operated, the wire 21 passes through the ink impregnated material 23 as shown in FIG. 2B. In other words, while the end portion of the wire 21 passes through the ink impregnated material 23, the ink is applied to the end face of the wire 21 and the end face of the wire 21 with the applied ink strikes the printing sheet 26 to make a mark thereon. One of the drawbacks accompanying the inking mechanism described above is that in the standby state the end portion of the wire is retracted behind the ink impregnated material. The wire activation operation must be very quick. Accordingly, in general, the stroke of the wire must be very short, for instance 0.3 to 1 mm. If the stroke of the wire is made longer, then the wire dot forming mechanism becomes considerably more intricate, even if a fast response is not required for the wire. Furthermore, since the ink from the ink impregnated material is adhered to the wire, it is considerably difficult to uniformly apply the ink circumferentially to the end of the wire when the wire is operated repetitively at high sped. As a result, the printed dot may not be uniform and, at worst, the printing operation cannot be carried out at all. In addition, the ink impregnated material has a tendency to clog. The described inking mechanism FIG. 2A,B further suffers a serious drawback in that, if ink is supplied by applying pressure to an ink supplying device in order to increase the ink supplying response, the ink may overflow. In some of the previous devices, the ink impregnated material is arranged near the front guide. However, the arrangement still suffers from the same drawbacks.

Figure 3B:
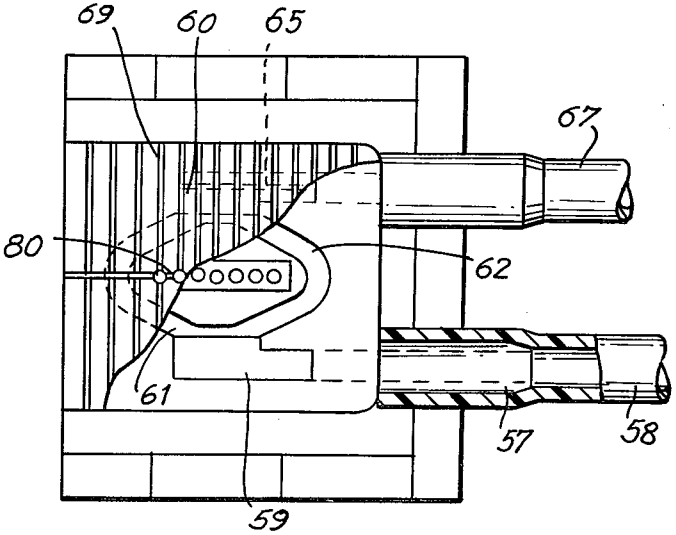
Figure 3C:
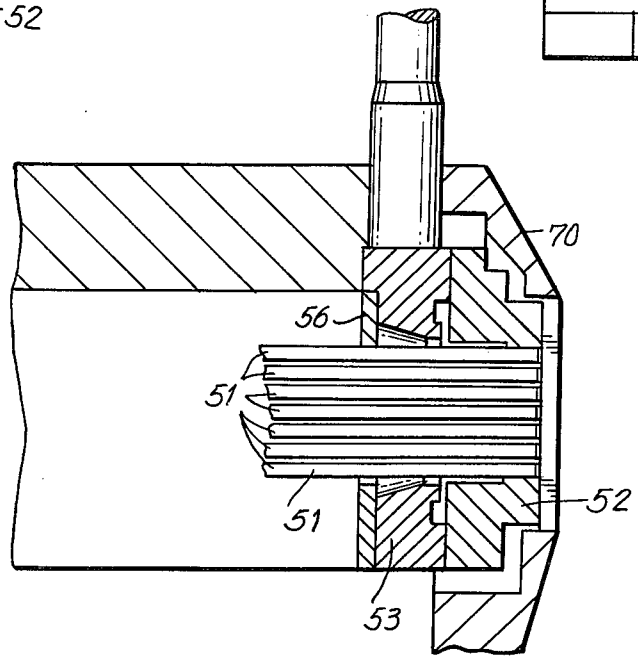
Figure 3A:
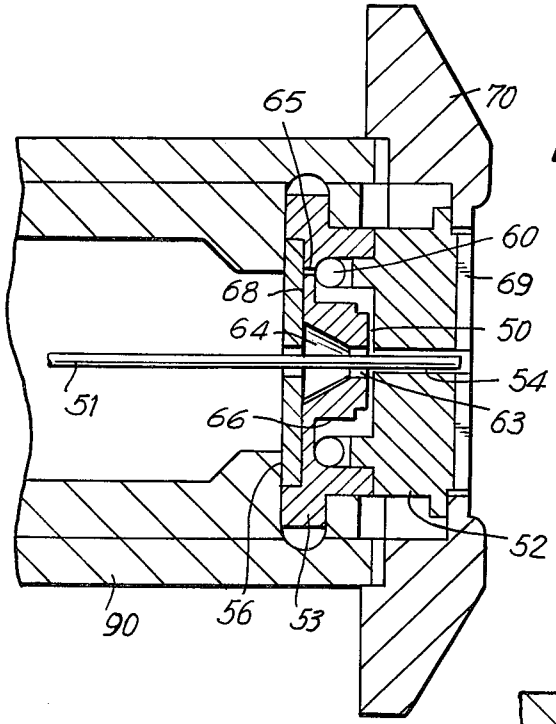

An embodiment of an inking mechanism constructed in accordance with this invention is shown in FIGS. 3A–3E. More specifically, FIG. 3A is a sectional view of an inking mechanism as viewed from above a dot head, and FIG. 3B is a view of the inking mechanism as viewed from the print end faces of the wires.

In FIGS. 3A–3E, the mechanism includes a wire 51, a wire guide 52 for guiding the end portion of the wire which includes the printing end face, a rear wire guide 53, and an ink path 50, which is formed between the wire guide 52 and the rear wire guide 53, crossing the wire 51 which is guided by the wire guide 52. The components for the rear wire guide 53 are shown in FIG. 3D in detail.

Further in FIGS. 3A–3E, there are a first ink supplying nipple 57, an ink supplying tube 58 coupled to the ink supplying nipple 57, an ink discharging tube 67 connected to an ink discharging nipple 74, an ink supplying port 59 communicating with the ink supplying nipple 57, and an ink discharging port 60 communicating with the ink discharging nipple 74. The ink supplying port 59 and the ink discharging port 60 are arranged substantially symmetrically with respect to a substantially central one of an array of seven wires and perpendicularly to the array of wires 51. In addition, ink bypasses 61, 62 connecting the ink supplying port 59 to the ink discharging port 60 are provided surrounding the array of wires.

The width and depth of each of the ink bypasses 61,62 are larger than those of the ink path 50 which crosses the paths of wires 51 so as to facilitate the flow of ink. The ink from the ink supplying port 59 is not directly fed to the ink path 50. Instead, the ink strikes a wall 66 of a flow path connecting the ink bypasses 61,62, the ink path 50 and the ink supplying port 59. Thereafter, the ink is divided between the ink bypasses 61,62 and the ink path 50.

The clearance 63 between the wire 51 and the wire rear guide 53 is made larger than the gap 54 between the wire 51 and the wire guide 52 so that pulsating ink pressure is relieved rearwardly of the wire.

A splashed ink recovering plate 56 is provided on the rear wire guide 53 with a space 64 formed therebetween in central portions. With the ink recovering plate 56 mounted on the rear wire guide 53, there is formed a capillary flow path 68 in the interface therebetween. In addition, an ink recovering path 65 connecting the capillary flow path 68 to the ink discharging port 60 is provided.

Thin ink controlling and recovering grooves 69 are formed in the top end face of the wire guide 52 adapted to guide the end portions of the wires 51. Some of the grooves are connected to the wire guide holes of the wire guide 52. The printing end faces of the wires 51 are set between the top end face of the wire guide 52 and the bottom of the ink controlling and recovering grooves 69. Reference numeral 70 designates a wire guide retainer.

The operation and effects fo the inking mechanism shown in FIGS. 3A–3E is now described in more detail. First, ink from the ink suplying tube 58 reaches the ink supplying port 59. Then, the ink is caused to strike against the wall 66 in the flow path which connects the ink supplying port 59, the ink bypasses 61,62 and the ink flow path 50 which crosses the wires. Thereafter, the ink is divided to flow along the ink bypasses 61,62 and the ink path 50, finally reaching the ink discharging port 60. In this operation, the main flow of ink flows in the ink bypasses 61 and 62 and ink does not flow directly in the ink path 50 which crosses the wires. Since the ink path 50 is formed as a small gap between the wire guide 52 and the wire rear guide 53, the capillary action of the gap pulls the ink into the ink path 50. The path 50 is filled with ink by the static pressure which is caused when the ink flows in the bypasses 61,62. The ink thus held in the ink path 50 is pulled up to the printing end face of each wire 51 by the capillary force which is generated in the gap 54 between the outer surface of the wire end the wire guide hole of the wire guide 52. The ink is pulled up also when the wire is operated as described hereinafter. The ink thus supplied near the printing end faces of the wires enters the ink controlling and recovering grooves 69 in the top end of the wire guide 52. Some grooves communicate with the wire guide holes. The ink is applied to the printing end face of each wire between the end portion of the wire 51, which is located between the bottom of the grooves 69 and the surface of the wire guide 52, as well as to the guide hole of the wire guide 52 so that a predetermined suitable amount of ink is adhered to the printing end face of the wire 51.

With the aid of the ink held in the ink controlling and recovering grooves 69, a stable ink supply response is provided as described below in more detail.

By way of example, operation where ink is supplied to the inking mechanism shown in FIG. 3 by means of a pump is now described. In this case, flow of ink is similar to that in the above-described case. However, two different techniques of using a pump can be utilized. In accordance with a first technique, a necessary amount of ink is supplied intermittently to the ink mechanism. In accordance with the the other technique, the ink is supplied continuously to the inking mechanism. With the first technique, the ink is fed with a pulsatile flow. The pulsatile ink flow first strikes the wall 66 of the path which communicates with the bypasses 61,62 and the ink path 50 which crosses the wires. Then, the main flow of ink runs into the bypasses 61,62 and the pulsatile flow of ink, whose pressure has decreased, runs into the ink path 50. Adverse effects due to the pulsating ink flow can be prevented to an extent by the use of an ink impregnated material. However, in this case, as was described above, it is difficult to cause a suitable amount of ink to stick to the end of the wire when the wire is operated at a high speed. In addition, the ink-impregnated material has a tendency to clog. It goes without saying that even a slight pulsatile flow which might remain should be eliminated.

In FIG. 3A, the gap 63 between the rear wire guide 53 and the wire 51 is larger than the gap 54 between the wire guide 52 and the wire 51. Accordingly, the pressure of any remaining pulsating flow is not transmitted towards the end of the wire but is releived rearwardly of the wire. If wires 51 are arranged as shown in FIGS. 3B and 3C, the ink runs rearwardly along the gaps between the wires in response to the pulsations of the pump. If the gap 63 between the wire 51 and the rear wire guide is made smaller, then the aforementioned phenomenon, that is, ink running rearwardly is insignificant and a slight ripple can then be observed on the wire print end face resulting in a slightly unclear printed pattern or character.

Using the technique of continuously feeding ink, it is difficult to maintain a constant rate of feeding ink. That is, the ink suffers from the pulsation problem although the problem may be less severe than in the first technique. However, with the inking mechanism in accordance with this invention, the pulsation of ink is substantially completely eliminated.

As described above, the dynamic pressure of the ink supplied in pulsations to the ink supplying port is exerted on the wall to cause the main flow to run into the ink bypasses so that, with the aid of the static pressure and the capillary action, the ink is supplied to the ink path 50 which crosses the wires. As a result, large ink pulsations are prevented. Furthermore, any pulsation which may remain is eliminated by making the clearance between the guide hole and the wire in front of the ink path smaller than that behind the ink path. By doing this, irregularities which otherwise may appear on the printing end faces of the wires are eliminated. Thus, in the inking mechanism in accordance with this invention, the ink is reliably supplied to the ends of the wires which substantially eliminates any clarity problems with the printed image.

In the inking mechanism shown in FIGS. 3A–E, an ink supplying port 59 and an ink discharging port 60 are provided. Accordingly, even if the ink is supplied to the inking mechanism, for instance, by a pump, in an excessive amount, the ink is delivered from the ink supplying port through the ink bypasses 61, 62 into the ink discharging port 60. As a result, the prints are never adversely affected by the excessive amount of ink, and the ink in the ink path 50 is never affected thereby. The resistance to the flow of ink in the ink path 50 is slightly higher than that to the flow of ink in either of the ink bypasses. However, because of the capillary action, the ink in the ink path 50 does not flow out and a certain amount of ink is held in the ink path 50 at all times, even if an excessive amount of ink from the inking mechanism is forcibly run through the ink discharging port 60 by the pump. Thus, a predetermined amount of ink is maintained in the inking mechanism by forcibly discharging the excessive ink from the inking mechanism. Accordingly, with respect to the operation of discharging the ink out of the inking mechanism or supplying ink thereto, it is not desirable to provide openings in the flow path extending from the ink supplying port 59 to the ink discharging port 60 through which ink goes out or air flows in except for the holes through which the wires extend and an opening for recovering ink. The predetermined quantity of ink can be more effectively maintained in the inking mechanism by forming the aforementioned path in such a manner that it is completely closed except for the above-described holes or opening.

In addition, it can be understood from the above description that a predetermined amount of ink can be maintained in the inking mechanism by providing an ink discharging capacity, for discharging excessive amounts of ink from the inking mechanism, which is greater than the ink supplying capacity for supplying ink from the ink supplying port into the inking mechanism.

In the embodiment shown in FIGS. 3A–E, even if the ink in the ink bypasses 61 and 62 is forcibly discharged through the ink discharging port 60 by a pump or the like, the ink in the ink path 50 is not discharged but is held by capillary action as described above. Furthermore, the ink path 50 is separated from the outer wall by the ink bypasses 61 and 62 which have a low resistance to the flow of ink and are formed surrounding the array of wires 51. Accordingly, the ink in the ink path 50 is pulled towards the wires 51 by the capillary actions of the array of wires which pass through the ink path 50.

An alternative embodiment of an inking mechanism in which a force pulling the ink towards the wires 51 is provided to improve the ink response is now described with reference to FIGS. 4A–4E.

Figure 4A:
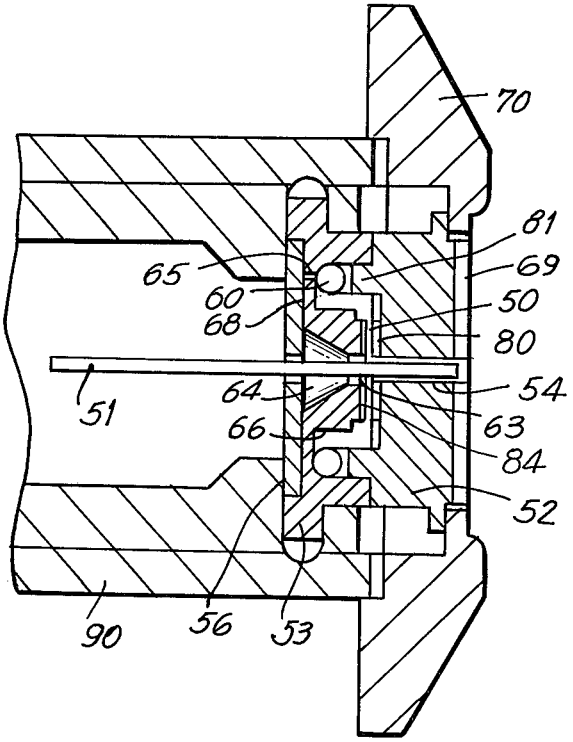
Figure 4B:
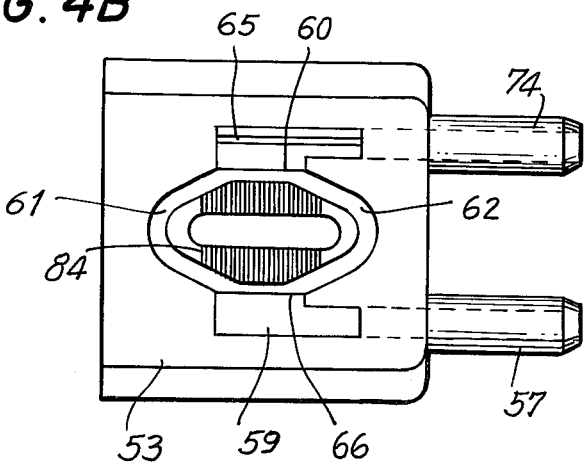
Figure 4C:
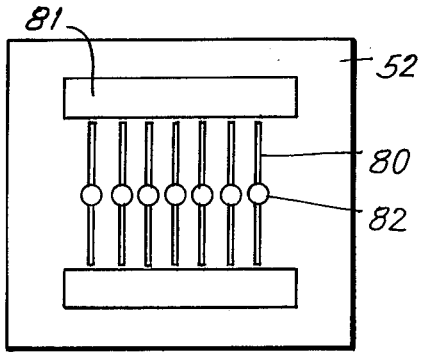

FIG. 4A is a sectional view of the inking mechanism in which grooves are formed in the surface of an ink path 50, FIG. 4B is a diagram showing the components of one example of a rear wire guide 53, and FIG. 4C is a plan view of a wire guide 52 as viewed from the side of the ink path 50.

Ink supplying grooves 80,84 providing capillary action are formed in the wire guide 52 and in the surface of the rear wire guide 53 facing the ink path 50 so that the surface of the ink path 50 has grooves providing a capillary action. The ink supplying grooves 80,84 are formed facing the wires 51.

In this case, the force of pulling the ink towards the wires 51 is increased to thus improve the ink response as a result of which sharp prints can be made at a high speed.

With reference to FIG. 4C, the number of ink supplying grooves 80 corresponds to the number of wires, although the invention is not limited thereto or thereby. That is, the grooves can be modified in number and in configuration. The same effect can be obtained by forming grooves in the surface of the wire guide 52 which faces the ink path 50 with some of the grooves communicating with the guide holes 82.

In order to increase the capillary force acting in the ink supplying grooves 80,84 it is desirable that the grooves be, for instance, V-shaped, that is, the configuration of each groove is such that the dimension of the outer part is larger than the dimension of the inner part.

Figure 4D:
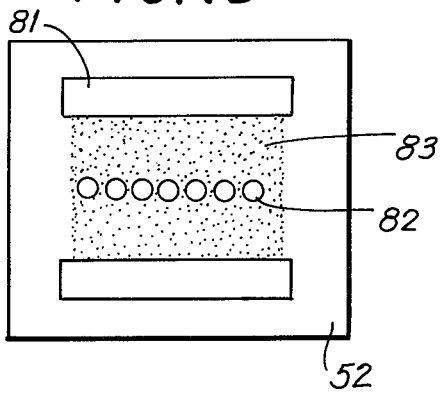

FIG. 4D is a plan view of another example of the wire guide 52, as viewed from the side of the ink path 50. The region around the wire guide holes 82 is formed with an uneven surface 83 (dotted area) by honing. The effect is similar to that of the ink suppying grooves 80.

Figure 4E:
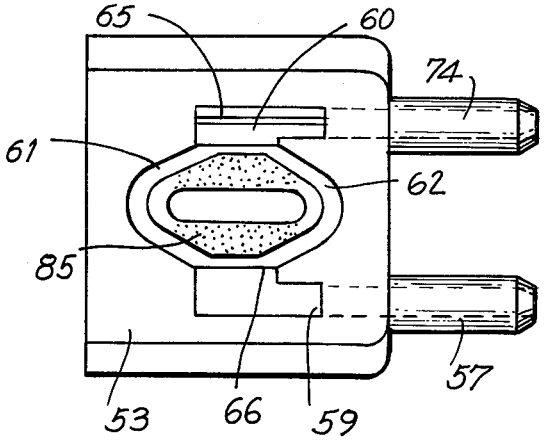

FIG. 4E is a diagram showing the components of another example of the rear wire guide 53 in accordance with the invention. In this case also, the surface facing the ink path 50 is formed with an uneven surface 85 provided by honing or the like. The effect is similar to that of the ink supplying grooves 84.

In providing the grooves for the ink path 50, the grooves may be cut either in the wire guide 52 or in the rear wire guide 53. However, since the clearance between the wire 51 and the wire guide 52 is smaller than that between the wire 51 and the rear wire guide 53 as described above, it is desirable that the grooves 80 be formed in the wire guide 52 in order to more effectively increase the force of pulling the ink towards the wires.

Figure 5:
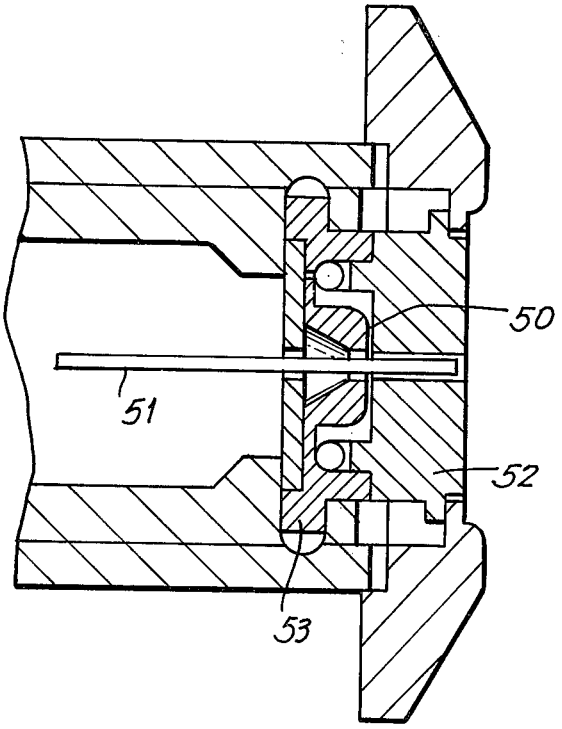
FIG. 5 is a diagram of another embodiment of the inking mechanism according to the invention.

In another alternative embodiment of the invention as shown in FIG. 5, the force of pulling the ink towards the wires is increased and, accordingly, the ink response is improved. More specifically, in the inking mechanism shown in FIG. 5, the clearance of the ink path 50 between the wire guide 52 and the rear wire guide 53 is increased outwardly of the position where the wires 51 are located. In the inking mechanism thus constructed, the capillary force in the central part of the gap is greater, and therefore the ink in the ink path 50 is pulled toward the central part, improving the ink response.

However, if ink bypasses 61,62 are provided surrounding the ink path 50 as described above, the tapered construction is not always required because of the considerably small clearance and the above-described effect.

The positional relationship of the ink supplying port and the ink discharging port will be described. In the case of FIG. 3, these ports are arranged symmetrically with respect to the array of wires extending perpendicularly to the array of wires. Accordingly, after striking the wall of the flow path communicating with the ink supplying port 59, the ink bypasses 61,62 and the ink path 50, the ink supplied into the inking mechanism is split to flow in the ink bypasses 61,62. Accordingly, the ink is uniformly applied to all of the wires in the ink path 50 substantially at the same time. On the other hand, the ink discharging port is positioned above the center line of the array of wire as described previously. With this arrangement, excessive amounts of ink can be discharged from any point in the ink discharging port.

According to experimental tests which have been performed, the following effects have been observed. If the ink supplying port 59 and the ink discharging port 60 are displaced from the position where, as described above, they extend perpendicularly to substantially the center of the array of wires and on both sides of the array of wires, a print made by the outermost wire closest to the ink supplying port may be of poor quality as the amount of ink used to make the print is relatively large while the amount of ink in a print made by the wire farthest from the ink supplying port may be relatively small. Similarly, as the ink discharging port is displaced, a print made of the endmost wire closest to the ink discharging port appears poor in quality as the amount of ink used is relatively small.

As is apparent from the above description, by positioning the ink supplying port and the ink discharging port symmetrically as described above, an inking mechanism is provided in which prints are made uniformly and the inking rate satisfactorily follows the high speed operation of the wires.

Figure 6:
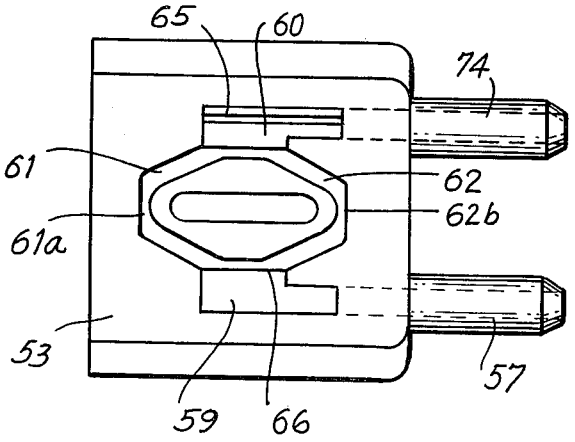
FIG. 6 is a diagram showing a modification of ink bypasses.

Furthermore, it has been confirmed experimentally that if the configuration (converging-diverging flow path) of each of the ink bypasses 61,62 is as indicated at *61a,61b* in FIG. 6 to vary the ink flow resistance, the ink delivery is improved and the ink is uniformly applied to all of the wires.

The printing operation of the wires 51 and the inking operation of the inking mechanism is now described.

The printing standby state of the wire 51 is shown in FIG. 3A. The ink held in the ink path 50 located behind the wire guide 52, adapted to guide the end portions of the wire, is drawn into the gap 54 between the wire 51 and the wire guide hole of the wire guide 52 by capillary action, reaching the printing end face of the wire 51 which is positioned retracted slightly from the top end surface of the wire guide 52. The ink is further drawn into the small ink controlling and recovering grooves 69, some of which communicate with the guide holes, also by capillary action.

In FIG. 3, the number of grooves corresponds to the number of wires; however, the configuration and number thereof are not limited thereto. That is, if the grooves are formed in the top end surface of the wire guide in such a manner that some of them communicate with the guide holes, the same effects as those described are obtained.

When the wire 51 is operated by the wire driving mechanism shown in FIG. 1, the printing end face thereof is struck against the recording sheet (not shown) and the ink on the printing end face is transferred to the recording sheet. In this operation, all the ink on the printing end face is not transferred and a very small part of the ink tends to splash because of the impact of the wire. The splashed ink sticks to the top end surface of the wire guide. However, that ink is recovered by the ink controlling and recovering grooves 69 provided in the top end surface of the wire guide whereby a suitable amount of ink is maintained on the printing end face of the wire at all times.

If no ink controlling and recovering grooves 69 are provided, the printer will have a drawback that, when the printing operation is stopped then started again, the amount of ink used in printing will be relatively large at first. On the other hand, with the use of the invention where the ink controlling and recovering groove 69 are formed in the wire guide surface so that, as the amount of ink becomes large, the excessive ink is removed through the ink controlling and recovering grooves 69 by capillary action in the grooves 69. Whereby, a suitable amount of ink is maintained on the print end face of each wire, and the aforementioned difficulty will not arise. It is desirable that the configuration of each ink controlling and recovering groove be such that the outer dimension is larger than the inner dimension, such as the use of a V-shaped groove, so as to increase the capillary force.

A portion of the wire guide closest to the print end face of the wire acts to control the quantity of ink applied to the printing end face. Therefore, even if the high-speed repetitive operation of the wire is continuously carried out, the desired predetermined quantity of ink is applied to the printing end face at all times. Accordingly, a print made by the wire is always excellent in quality.

In supplying the ink to the printing end face of the wire from the ink path 50, the ink is delivered near the printing end face of the wire 51 and enters the ink controlling and recovering grooves 69 due to capillary action and by the pumping action due to surface viscous resistance which is provided when the wire 51 is operated (reciprocated). In addition, when the wire is returned, the ink is pulled back. Thus, when these actions are balanced with the ink holding capacity described above, the aforementioned suitable quantity of ink is obtained and applied to the printing end face of the wire 51 at all times.

As described above, when the wire 51 strikes the recording sheet, all of the ink on the printing end face is not transferred to the recording sheet and a part of the ink is splashed. The splashed ink is recovered by the ink controlling and recovering grooves 69, which greatly reduces the ink consumption. At the same time, this protects the printer and the recording sheet from being fouled or smudged by the splashed ink. Moreover, if the ink controlling and recovering grooves 69 are formed in the entire top end surface of the wire guide in such a manner that their flow paths communicate with the wire guide holes, they will perform their function more effectively.

The ink is splashed not only when the wire strikes the recording sheet but also when the wire 51 is returned to its standby position although the quantity of ink splashed in the latter case is very small. The latter phenomenon is caused by the high speed operation of the wire wherein the ink on the surface of the wire is splashed due to the high speed operation of the wire. In accordance with the invention, as shown in FIG. 3, an ink recovering plate is provided behind the rear wire guide 53 to form the space 64 therebetween. The space 64 thus formed serves to cut the flow path to the ink path 50 which crosses the wires so that the ink splashed when the wire 51 returns to its standby position is caused to strike against the ink recovering plate 56 and hence is recovered.

Ink stuck to the ink recovering plate 56 is recovered through the capillary path 68 formed between the ink recovering plate 56 and the rear wire guide 53 by capillary action and through an ink recovering path 65 which communicates with the ink discharging port 60. However, since the amount of ink splashed backwardly is very small, it is not always necessary to connect the ink recovering path to the ink discharging port 60. Alternatively, the ink recovering plate 56 may be made of a material capable of absorbing ink. However, if the ink recovering plate is removed, then the splashed ink cannot be stopped at the position where the ink recovering plate was located. Therefore, although the amount of ink splashed is quite small as described above, a serious problem, that the interior of the wire dot head is contaminated by ink, arises.

Figure 7B:
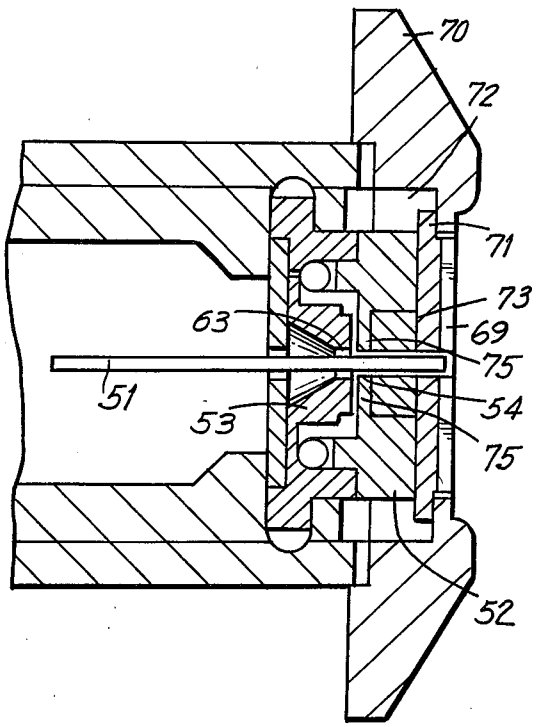
FIGS. 7A and 7B are diagrams showing other embodiments of inking mechanisms in accordance with the invention.
Figure 7A:
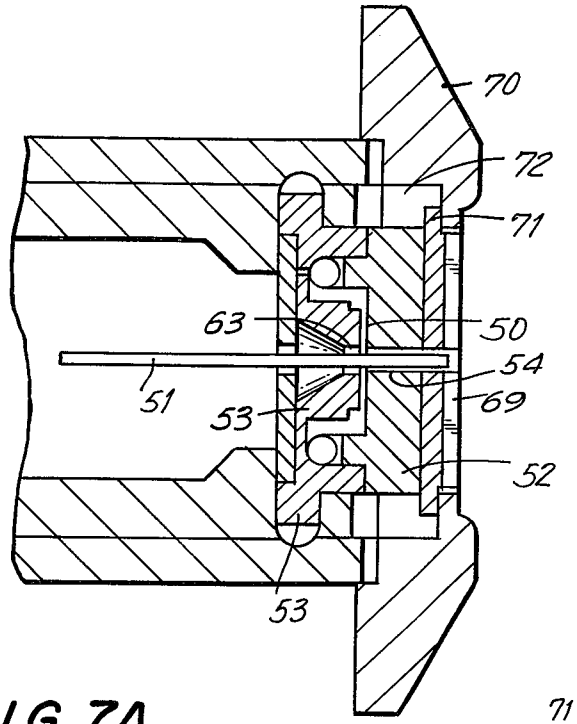

FIG. 7A shows another alternative embodiment of the invention which differs from that of FIG. 3 in that a wire guide adapted to guide the end portions of the wires is made up of two parts. Specifically, an auxiliary guide 71 is provided on the side of the print end faces of the wires.

The auxiliary guide 71 is mounted between a wire guide retainer 70 and the wire guide 52 in such a manner as to be slidable on the end surface of the wire guide 52 in accordance with the positions of the wires 51 which are guided through the guide holes of the wire guide 52. In this structure, the ink is held between the wire guide 52 and the auxiliary guide 71 by capillary force. The problem of ink flowing around the structure can be prevented by providing a space 72 which cuts the capillary path which is formed around the auxiliary guide 71 and the capillary path of the ink which flows out of the inking mechanism. The end portions of the wires are positively guided by the wire guide 52 and the auxiliary guide 71 is slidably mounted on the wire guide 52. With this construction, very little side pressure from the wires is exerted on the auxiliary guide 71. Even if side pressure is applied to the auxillary guide 71, the latter moves to a position where the side pressure is minimized. Thus, the auxiliary guide can sufficiently withstand the reciprocation of the wires and the wire guide holes are scarely worn with the result that the clearance between the wire and the wire guide hole is maintained constant.

Accordingly, in the wire dot printer according to the invention, a desired predetermined quantity of ink is reliably supplied to the printing end faces of the wires over long periods of time, and therefore prints made by the wires are of considerably high quality at all times. If small ink controlling and recovering grooves 69 such as those described before are cut in the top end surface of the auxiliary guide 71 communicating with the wire guide holes, the same effects can be obtained as previously described.

It is desirable that the auxiliary guide be manufactured accurately. Accordingly, it is preferable that the configuration of the auxiliary guide be such that it can be readily machined to the required accuracy. Therefore, an assembly, constructed by stacking a plurality of thin auxiliary guides one on another and formed by pressing, may be used. Since the auxiliary guide must be durable to some extent, it is preferable to stack thin auxiliary guides one to another. It has been found experimentally that capillary paths are formed between the adjacent auxiliary guides with the result that control over the quantity of ink is achieved near the printing end faces of the wires. Thus, the use of the plural stacked auxiliary guides provides an advantage that a stable ink delivery is provided.

Figure 8:
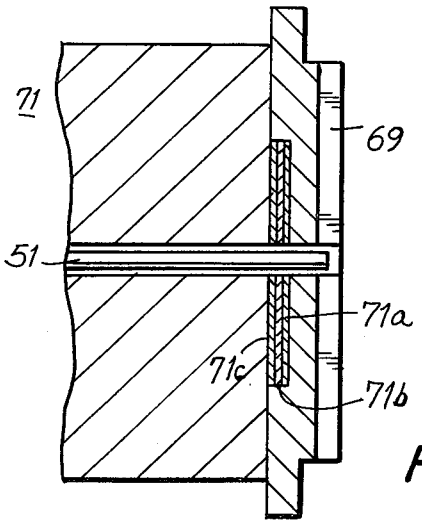
FIG. 8 is a diagram of an auxiliary guide in a print head.

Since it is preferable that ink controlling and recovering grooves 69 such as those described above be formed in the top end surface of the auxiliary guide, the configuration of the auxiliary guide may be modified as shown in FIG. 8 which shows another example of the auxiliary guide 71. In FIG. 8, reference numeral 69 designates the above-described ink controlling and recovering grooves, and 71*a*, 71*b* and 71*c*, thin auxiliary guides provided on the rear side of said grooves 69. Only three thin auxiliary guides are shown in the figure; however, the number of thin auxiliary guides is not limited to three. In this case, the durability of the auxiliary guide is maintained as required and the accuracy is also maintained for long periods. Thus, an inking mechanism having an improved inking operation is provided.

An inking mechanism in which, instead of using the ink controlling and recovering grooves described above, an ink absorbing material is provided on the front surface thereof, has been tested to determine whether or not the same effects can be obtained. Satisfactory results were in fact obtained when printing was continuously carried out. However, when the printing operation was restarted after being suspended for a time, the inking mechanism suffered a disadvantage in that the resultant prints were not sharp. It is considered that this was caused by the fact that the ink response with the ink absorbing material is lower than that with the grooves.

As described above, a certain degree of accuracy is required for the clearance between the wire guide holes in the auxiliary guide and the wire. In the case where a plurality of wire guide holes are formed in the wire guide, it is desirable that partition walls remain between adjacent wire guide holes without being cut thereby.

However, since the wires are adjacent to one another, the partition walls may be slightly cut by the adjacent wire guide holes thus forming small flow paths. It has been found that the small flow paths thus formed are useful for controlling the ink response. Accordingly, it is desirable that the wire guide holes be designed to surround the wires as much as possible although the small flow paths 80 tend to form between adjacent wire guide holes as shown in FIG. 3B.

In order, in the structure as shown in FIG. 7A, to improve the durability of the wire end portion guiding section and to extend the service life of the wire dot printer head, a wire guide bearing 73 made of a bearing material such as ruby which has a high wear resistance, may be inserted into the wire guide 52 as shown in FIG. 7B. Since machining a hard material such as ruby is difficult, it is also difficult to machine the hard material in such a manner that the latter surrounds the wire 51 entirely in the wire guide. A bearing supporting portion 75 is provided in the wire guide 52 so that the gap 54 between the wire and the wire guide hole is smaller than the gap 63 between the wire 51 and the rear wire guide 53. In this case, an inking mechanism having a long service life is provided without adversely affecting the function of the ink path which is formed crossing the wires. The material of the durable bearing 73 may also be a plastic or ceramic material so long as it is different from the material of the wire guide 52 and has a greater durability than the material of the wire guide. In this connection, it is desirable that the durable bearing be inserted sufficiently far into the wire guide 52 so that no additional capillary path (other than the gap between the wire 51 and the wire guide 52) to the printing end faces of the wires is formed.

Figure 9C:
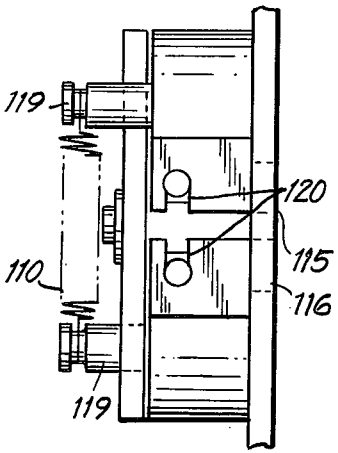
FIG. 9C is a side view of the pump in FIG. 9A.
Figure 9B:
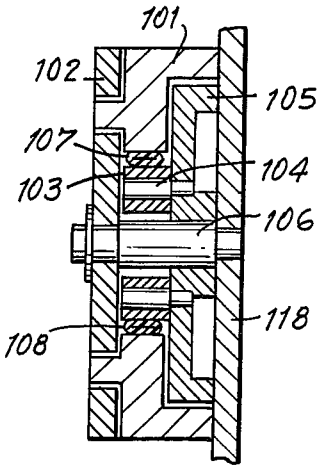
FIG. 9B is a sectional view taken along line A—A′ in FIG. 9A.
Figure 9A:
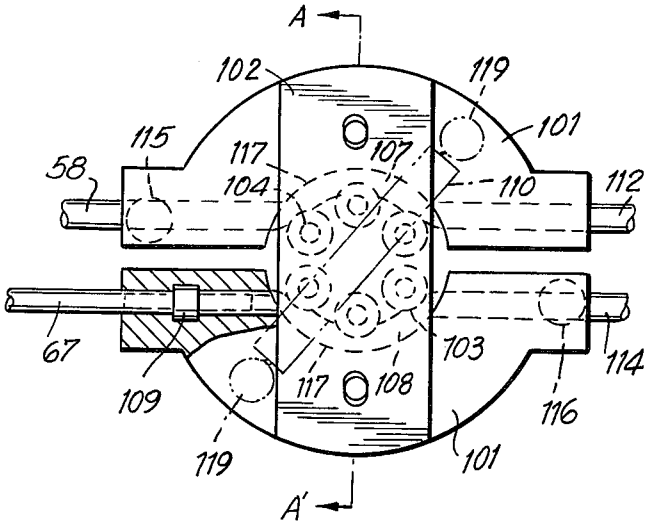
FIG. 9A is a front view of a peristaltic pump employed in a wire dot printer using a fluid ink in accordance with this invention.

FIG. 9A is a front partly sectional view, showing a peristaltic pump in accordance with this invention. FIG. 9B is a sectional view taken along line A—A' in FIG. 9A, and FIG. 9C is a side view of the pump shown in FIG. 9A.

In FIGS. 9A–C, the pump includes a housing 101 having an arcuate guide member 117, an upper cover 102, rollers 103 rotatably mounted on a shaft 104, and a rotary plate 105 on which roller shafts 104 are arranged at equal intervals along the circumference of the rotary plate 105. The rotary plate 105 has gear teeth cut in the periphery thereof which engage with a train of gears (not shown) driven by a drive source (not shown) to turn the rotary plate 105 around a central shaft 106. The central shaft 106 is fixedly secured to a frame 118.

Further, in FIGS. 9A–C, the pump includes elastic tubes 107,108 of silicone rubber or the like, and connectors 109. The connectors 109 are used to connect the elastic tube 107 to ink supplying tubes 58, 112 and to connect the elastic tube 108 to ink discharging tubes 67, 114 as shown in FIG. 9A. The connectors 109 are inserted fixedly into slots 120 in the housing 101 as shown in FIG. 9C. The inside diameter of the elastic tube 108 is larger than the inside diameter of the elastic tube 107.

A spring 110 is fastened to spring hooking rods 119 on the housing 101 to urge the housing 101 towards the rollers 103. The spring 110 is so designed that each of the elastic tubes 107, 108 is depressed by a suitable value of 15 to 20% of the wall thickness of the tube. The ink supplying tube 58 and the ink discharging tube 67 are coupled to the printer head (described above) while the ink supplying tube 112 and the ink discharging tube 114 are coupled to an ink tank (not shown) holding a supply of ink. The material of the ink supplying tubes 58,112 and the ink discharging tubes 67,114 may be the same as that of the elastic tubes 107,108. However, if the tubes are made of a material such as a polyvinylidene chloride having low moisture and gas permeability, better results are obtained as described hereinafter.

Further in FIGS. 9A–C, the pump includes rotary shafts 115,116 of the housing 101 which are fitted in the frame 118.

Operation of the peristaltic pump thus constructed is now described. The rotary plate 105 engaged with the train of gears driven by the drive source is rotated counterclockwise and hence, the rollers 103 are moved around the central shaft 106. In this operation, the rollers 103 move while depressing the elastic tubes 107,108 against the guides 117. Accordingly, the rollers rotate in a direction opposite to the plate direction of revolution while pressing against the elastic tubes 107,108. When a roller which depresses either of the elastic tubes 107,108 has passed the elastic tube, the tube is restored in shape after which the next roller depresses the elastic tube. Thus, depression and restoration of the elastic tubes 107,108 are alternately carried out by the rollers 103. This results in a pumping action such that suction and discharge are alternately carried out and the fluid in the elastic tubes 107,108 is delivered counterclockwise at a predetermined rate.

In the pump described above, the housing 101 is divided into two parts which are rotatable around the shafts 115,116 respectively, and are urged towards the rollers 103 by spring 110. Even if the elastic tubes are not uniform in wall thickness or the components are not uniform in machining accuracy, the elastic tubes will be depressed to a predetermined suitable value. Accordingly, the pumping action will be carried out correctly, and the problem that the durability of the elastic tubes is reduced by excessively depressing them is prevented.

According to the invention, the housing is divided into two parts as described above. With this housing construction unlike the conventional integral housing, the elastic tubes can be replaced without having to repetitively move the rollers. In other words, in the pump in accordance with this invention, the elastic tubes in the housing can be replaced with the rollers set as they are. This greatly improves the efficiency of assembling of the pump.

Furthermore, in accordance with the invention, connectors are employed to connect one elastic tube to the ink supplying tubes and to connect the other elastic tube to the ink discharging tubes, respectively. This provides the following advantages. If the ink supplying tubes or the ink discharging tubes were a piece of tube which is alternately depressed and restored as in the pump described above and the portion within the pump structure were deteriorated, then it would be necessary to replace the tube in its entirety. However, in accordance with this invention, with connectors employed as described above, if the elastic tube deteriorates, it is unnecessary to replace the ink supplying tube or the ink discharging tube. All that is necessary in this case is to replace the deteriorated elastic tube 107,108 within the pump. This contributes to the economical use of the components.

FIGS. 10A and 10B show rollers in an alternative embodiment of a peristaltic pump in accordance with the invention. More specifically, FIG. 10A shows an ordinary depressing roller and FIG. 10B shows a relieving roller. FIGS. 11A and 11B show the rollers in FIGS. 10A and 10B in operation, respectively. FIGS. 12A and 12B are a sectional view of an elastic tube. More specifically FIG. 12A shows the initial or new state of the tube, and FIG. 12B shows an aged state of the tube in which the fatigue of the tube is advanced, as a result of which the restoring force of the tube is decreased.

While the elastic tube of the peristaltic pump is new, it can restore itself following depression to a circular cross section as shown in FIG. 12A. However, after the peristaltic pump has operated repeatedly for a period of time, fatigue of the tube advances; the tube becomes harder and tends to flatten. As a result, the tube can restore itself only to a state as shown in FIG. 12B. Accordingly, the quantity of fluid delivered by the pump is decreased, and at worst the pump can deliver no fluid at all.

In a peristaltic pump in accordance with the invention, the depressing roller 123 having a straight section as shown in FIG. 10A and the relieving roller 124 being recessed centrally in cross section as shown in FIG. 10B, are alternately arranged on the rotary plate 105 (FIGS. 9A–C) to increase the durability of the tube. As shown in FIG. 11A, the depressing roller 123 depresses the elastic tube 127 against the guide 137 so that the tube is closed. On the other hand, as shown in FIG. 11B, the relieving roller 124 pushes inwardly the upper and lower portions of the tube 127 which has been flattened by the depressing roller 123 to allow the tube to restore itself to a circular section.

The alternate arrangement of the depressing roller and the relieving roller is significantly effective in that even if the peristaltic pump is operated repeatedly, the elastic tube can restore itself completely after being depressed. Flow rate is maintained substantially unchanged, and the durability is greatly increased.

In accordance with the invention, a peristaltic pump is employed in which the elastic tubes of two systems, ink supplying and discharging systems, are disposed between the rollers and the housing, and the inside diamter of the ink discharging elastic tube is made larger than that of the ink supplying elastic tube. Accordingly, the ink discharging capacity is larger than the ink supplying capacity. Therefore, as described above, a predetermined quantity of ink is reliably maintained in the inking mechanism and a suitable amount of ink is supplied to the printing end faces of the wires at all times.

Further in accordance with the invention, a peristaltic pump, performing a pumping action by depressing and relieving the elastic tubes with the rollers, is employed so that a suction action and a valve action are employed to supply ink to, and to discharge the ink from the inking mechanism in the wire dot printer. Even if air is introduced into the ink supplying tube or in the ink discharging tube, sufficient ink is still supplied to or discharged from the inking mechanism. Therefore, the dot printer is free from the problem such as in a pump using no valve action, that mixing of air into the tubes makes it impossible to pump ink. This results in the ink overflowing in the inking mechanism, or the supply of ink to the inking mechanism is interrupted.

Furthermore, the invention has the following advantageous effect. Even if the pump is stopped when the printing operation is suspended, the volume of ink in the ink supplying tube 58 and ink discharging tube 67 is maintained irrespective of the relative position of the pump and the printer head. For instance, even if the printer head faces downwardly, the inking mechanism if free from the problem that the ink in the inking mechanism is pressurized causing it to overflow the wire guide holes. Accordingly, immediately after the printing operation has been restarted, prints of excellent quality can be made.

Owing to the valve action of the pump itself, the ink tank can be freely positioned with respect to the position of the pump in both positive pressure and negative pressure directions. Accordingly, the degree of freedom in designing the layout of a printer is increased making it easier to provide a compact printer.

The materials of the ink supplying tube and the ink discharging tube are now described. The materials of the ink supplying pipes 58,112 and the ink discharging pipes 67,114 may be the same as that of the elastic tubes 107 and 108. However, silicone rubber is not suitable as the material of the ink supplying tubes for the following reason. An elastic tube of silicone rubber has a high moisture permeability and gas permeability. Therefore, if the printing operation is not carried out for several days and the elastic tubes are inoperative, even at room temperature, for several days, the ink in the ink supplying tube will evaporate, thus forming one or more regions in the ink supplying tube in which no ink is present.

While such regions are present in the tube, it is impossible to deliver ink from the space to the inking mechanism. If the printing operation is carried out under this condition, after the ink in the ink path 50 which crosses the wires, the ink between the wires, and the ink in the gaps between the wires and the wire guide holes has been used up, no ink is supplied to the printing end faces of the wires for a time. Hence, the wires will strike the recording sheet under the condition that no ink is adhering to the printing end faces and no print will be made on the recording sheet. This condition lasts until ink from the pump again reaches the ink supplying port 59 to fill the ink path 50 and to adhere to the printing end faces of the wires.

This difficulty may be eliminated by employing a procedure in which the pump is operated before a printing operation starts so that the printing operation is started only after the ink from the ink tank has reached the inking mechanism. However, that procedure is disadvantageous in that the printing operation cannot be carried out for the period of time required for delivering the ink from the ink tank to the printer head, which lowers the performance of the printer.

In order to eliminate this drawback, it is desirable that the tubes forming the ink flow paths other than those in the pump be made of a material such as polyvinylidene chloride, polyethylene or polypropylene which have a low moisture permeability. The inventors have discovered experimentally that if ink supplying tubes made of polyvinylidene chloride, polyethylene and polypropylene are employed, no ink void regions are formed therein, even if they are held at room temperature for 30 days or more. Accordingly, the printer is free from the difficulty that no printing can be carried out. According to the test method of JIS (Japanese Industrial Standard) Z0208, the moisture permeabilities of polyvinylidene chloride, polyethylene and polypropylene are 1–2 $g/m^2$, 24 h; 5–10 $g/m^2$, 24 h; and 8–12 $g/m^2$, 24 h, respectively. On the other hand, the moisture permeability of silicone rubber is of the order of 100 $g/m^2$, 24 h. It has been determined experimentally that tubes made of a material having a moisture permeability of 30 $g/m^2$, 24 h or less produced satisfactory results.

If the ink supplying tubes other than those in the pump are made of a material having a low moisture permeability, even if the tubes are held in a inoperative condition for a long period of time, the ink in the tubes will evaporate negligibly. Therefore, it is unnecessary to operate the pump before the printing operation is started again, That is, even if the pump is started simultaneously with the start of the printing operation, from the beginning of the printing operation, satisfactory prints are made on the recording sheet.

Tubes made of a material such as polyvinylidene chloride, polypropylene or polyethylene, having a low moisture permeability have lower elasticity and lower restoring forces than elastic tubes made of a material such as silicone rubber, and accordingly are not suitable as tubes within the peristaltic pump.

As is apparent from the above description, in a peristaltic pump in accordance with the invention, a predetermined amount of ink is reliably maintained in the inking mechanism of the printer head, and a suitable amount of ink is supplied to the printing end faces of the wires at all times. As a result, prints are made reliably and satisfactorily over long periods.

A peristaltic pump in accordance with the invention is applicable to another dot printer having a print head using a fluid ink, such as an ink jet printer and so on.

Now, the structures of the ink supplying tube and the ink discharging tube are described. In accordance with the invention, the ink supplying tube for supplying ink into the inking mechanism of the printer head and the ink discharging tube for discharging surplus amounts of ink from the inking mechanism, are combined with a belt-shaped support to form a belt-shaped ink supplying tube. In this aspect, the invention facilitates the attachment of the ink supplying and discharging tubes to the printer frame and provides for an improved durability of the tubes.

FIG. 13 is a sectional view of an embodiment of a belt-shaped ink tube unit 141 in accordance with the invention. In FIG. 13, it is seen that the belt-shaped ink unit 141 includes a hole 142 on the ink supplying side, a hole 143 on the ink discharging side, and a belt-shaped support 144 in between. As is apparent from FIG. 13, the belt-shaped support, the ink supplying tube and the ink discharging tube are formed as a single unit. Preferably, the belt-shaped ink tube unit is made of resin such as polyethylene.

As described above, it is desirable that the ink discharging capacity be larger than the ink supplying capacity. Accordingly, the hole on the ink supplying side is smaller in diameter than the hole on the ink discharging side.

Figure 15:
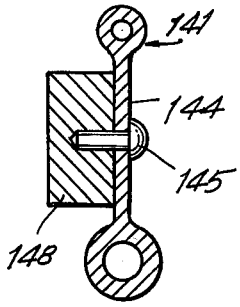
FIG. 15 is a sectional view showing the belt-shaped inking supplying tube unit secured to the frame of the printer.
Figure 16:
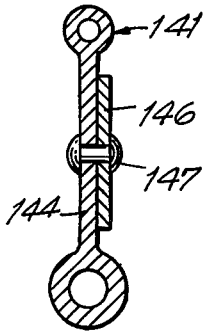
FIG. 16 is a sectional view showing the belt-shaped inking supplying tube unit combined with an electromagnet driving cable.

FIG. 14 is a perspective view showing an embodiment of a wire dot printer using fluid ink which is equipped with the belt-shaped ink tube unit 141 in accordance with the invention. FIG. 15 is a sectional view showing the belt-shaped ink tube unit 141 secured to the printer frame. FIG. 16 is a sectional view showing a combination of the belt shaped ink tube unit 141 and the electromagnet driving cable of the printer head.

In FIG. 14, the printer includes frames 148,149, a head base 150, guide shafts 151,152 for the head base 150, a lead cam 153 in the surface of which grooves are cut helically so that the head base 150 is reciprocated horizontally as the lead cam turns, and a printer head 154 secured to the head base 150.

Further, in FIG. 14, the printer includes a pump 155 for supplying ink from an ink supply tank (not shown) to the head 154 and for discharging surplus quantities of ink to the tank for recovery, a motor 156, a connector 157, an electromagnet driving cable 146, a base plate 158, a printing sheet 159, and a platen 160. The electromagnet driving cable 146 is connected to the connector 157 on the base plate 158 to supply electric current to the head 154.

When the motor 156 is operated, the lead cam 153 engaged with a train of gears driven by the motor is rotated as a result of which the head base 150 is reciprocated horizontally while printing is carried out by the head 154.

As shown in FIG. 15, holes are formed in the belt-shaped suppport 144 of the belt-shaped ink tube unit 141 and the tube unit 141 is fixedly secured to the frame 148 with screws 145 inserted into the holes thus formed.

As shown in FIG. 16, the tube unit 141 and the electromagnet driving cable 146 are joined together with tightening members 147, such as pins. The tube unit 141 and the cable 146 are bent as one unit as shown in FIG. 14. Accordingly, unlike a construction where the ink supplying tube, the ink discharging tube and the cable 146 are provided separately, these elements can never rub against one another. This provides for increased durability.

Figure 17:
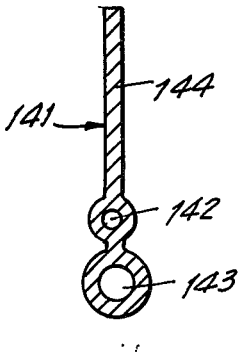
FIG. 17 is a sectional view showing an alternative embodiment of a belt-shaped inking supplying tube unit.

FIG. 17 shows an alternative embodiment of a belt-shaped ink tube unit in accordance with the invention in which those components which have been described with reference to FIG. 13 have similar reference numerals. In this example, the hole 142 on the ink supplying side is adjacent to the hole 143 on the ink discharging side, that is, the ink supplying tube and the ink discharging tube, which are positioned adjacent to each other, and the belt-shaped support 144 are again combined into a single unit. The advantages are the same as those of the first embodiment shown in FIG. 13.

As is apparent from the description above, since the belt-shaped ink tube unit of this invention, is formed by combining the ink supplying tube, the ink discharging tube and the belt-shaped support 144 into a single unit, holes can be formed as desired in the belt-shaped support 144. This facilitates attachment of the tubes to the frame. In addition, as the belt-shaped ink supplying tube can be readily combined with the electromagnet driving cable, durability of these moving elements is greatly improved. Furthermore, as the tube hole on the ink supplying side has a smaller diameter than the tube hole on the ink discharging side, the period of time required for the ink to reach the printer head is much shorter than that required in the case where the holes are equal in diameter.

The characteristics of ink suitable for the inking mechanism of the wire dot printer in accordance with this invention are now described. The essential conditions for ink suitable for the inking mechanism are that the ink can follow the high speed reciprocation of the wires and can reliably and positively stick or adhere at a suitable rate, to the printing end face of each wire. These conditions are described with reference to experimental results relating to the viscosity of the ink.

Figure 18A:
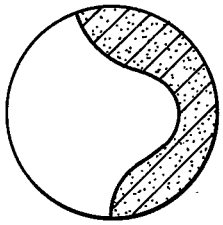
FIGS. 18A and 18B are diagrams showing the configurations of dots printed with an ink of very high vicosity and with an ink of lower viscosity respectively.
Figure 18B:
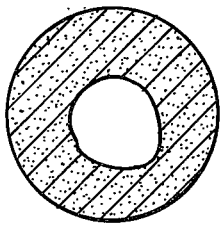

First, the viscosity of ink is described with respect to a case where, by way of example, the configuration of the end face of each wire is circular. If the viscosity of the ink is cosiderably high, then the ink will not uniformly adhere to the end face of the wire, as shown in FIG. 18A. Accordingly, the printed dot will not be circular and there may be blank portions. If, on the other hand, the viscosity is decreased somewhat but is still too high, the central portion of the dot will not be printed, as shown in FIG. 18B. If the viscosity is further decreased to a value suitable for the inking mechanism, the ink on the end face of the wire will be uniformly transferred onto the printing sheet and the printed dot is circular.

It has been determined experimentally that the value of the viscosity should be about 20 c.p. If the viscosity is too high, the ink cannot follow the high-speed reciprocating motion of the wires and accordingly a printed dot is liable to be nonuniform in density.

As is well-known, as the temperature of a liquid decreases, the viscosity increases, and as the temperature increases, the viscosity decreases. Experiments have been performed to determine a suitable viscosity taking the expected temperature changes into account. As a result of the experiments, it has been found that a viscosity of 10 c.p. at room temperature is optimum. With this viscosity, satisfactory dots are printed.

The drying characteristic of the ink is now considered. The ink is prepared with a wetting agent in which coloring matter (dye and pigment) is dissovled and water, although sometimes water may not be used. Depending on the properties of the wetting agent, a dryable ink is provided. Alternatively, an ink which scarcely dries may be prepared. Examples of the wetting agent are described below.

First, the case where a dryable ink is used is described. Since the ink itself is dryable, the ink droplets which are scattered when the ink on the wire end face strikes the recording sheet are so small that they dry immediately. Accordingly, the scattered ink droplets will never foul the printer or parts around the printer. The same is true for ink which is splashed backwardly of the wire guide section when the wire returns to its standby position. Since the ink transferred onto the sheet is readily dried, even if the ink on the sheet is rubbed with the hand or the like, the sheet remains clean. This is one merit of dryable ink.

However, dryable ink suffers from a disadvantage that, since it readily dries, if the wire dot head is held in a standby state, then the ink in the inking mechanism will dry. At worst, only the coloring matter will remain. The dry coloring matter may jam the wires in the inking mechanism as a result of which it may be impossible to operate the wires. It has been confirmed experimentally that this problem can be eliminated by employing a method in which the ink is forcibly supplied into the inking mechanism to dissolve the solidified coloring matter thereby to decrease the viscosity. However, the printing operation cannot be carried out until the wires have been rendered movable.

If the printer were further inoperative for a long time, then the ink in the ink supplying tube for supplying ink to the inking mechanism would dry as a result of which there would be formed a region where no ink is present between the inking mechanism and the ink tank. Accordingly, no ink could be supplied for a period of time determined by the volume of the empty space and the pumping rate.

An example of a procedure for solving this problem is as follows. Even while the inking mechanism is in the standby state, the ink is supplied into the inking mechanism by the pump so that the ink is forcibly discharged through the ink discharging port. If this procedure is employed, the problems related to the drying of ink in the inking mechanism and in the ink supplying tube will be eliminated. However, this procedure involves another problem which cannot be solved without making the construction more intricate.

This problem can be solved by employing an ink which is not so quickly dried. In addition, the problem as due to the splashing of ink can be solved by use of the above-described ink recovering mechanism in accordance with the invention. The conditions required for an ink which is less quickly dried relatively is now discussed. The vapor pressure of an ink may be employed to express how readily the ink will dry. Since water vapor pressure at room temperature is about 20 mm Hg, the ink is not rapidly dryable when compared with the water.

It has been found experimentally that the saturated vapor pressure at room temperature of the wetting agent of the ink in the inking mechanism should be less than 0.1 mm Hg. This pressure allows the wires to be in the standby state for long time periods without difficulty and to permit a printing operation to be commenced immediately. The use of such a wetting agent makes the ink relatively not dryable. If ink thus prepared is employed, the function of the inking mechanism is maintained over long periods, and accordingly, the printing operation can be reliably carried out with high quality.

An example of a wetting agent which was tested experimentally is triethylene glycol. The viscosity of triethylene glycol is about 48 c.p. at room temperature. If an appropriate amount of dye is added to triethylene glycol, the resultant viscosity is about 60 c.p. The saturated vapor pressure at room temperature of triethylene glycol is lower than 0.01 mm Hg.

The viscosity can be decreased by adding water. In the case where this ink is employed, no vapor which may affect the inking mechanism is created because the saturated vapor pressure at room temperature is about 0.01 mm Hg. Even if all the water content of the ink in the inking mechanism evaporates, the printing operation will not be adversely affected because the viscosity of the ink is about 60 c.p. The disadvantage that the interior of the inking mechanism dries making the wires inoperable, does not arise. Immediately, when the printing operation is started, the viscosity can be decreased by ink delivered by the ink supplying device so that printing can be carried out with a high quality. For this purpose, the amount of wetting agent satisfying the above-described conditions should be more than 20% of the amount of ink.

The proper amount of wetting agent can be determined from the amount of coloring matter which can be dissolved with stability in the wetting agent and from the relation between the density of printing and the amount of coloring matter.

Experiments have been performed to determine the durability of the wires depending on pH of the ink employed with the printer. It has been found that, with an ink having a pH of approximately 6, the wires in the wire dot head are abnormally worn during durability testing. Wires made of different materials have been tested. However, it has been found that wires of other materials also wear abnormally when compared with the wear when a conventional ink ribbon is used, although the degrees of wear of the wires differ somewhat according to the material. The same tests were performed on new wires using inks having pH's of about 7 and 10. In these tests, the wires did not wear abnormally, and the degree of wear is substantially the same as that when an ink ribbon is used. Thus, it is desirable to use an ink having a pH of 7 or higher for the wire dot printer and the inking mechanism. If such an ink is used, the durability of the printer will be maintained. The wires may be made of piano wire or alloy with cobalt base or the like.

As described above, in accordance with the invention, while ink is supplied into the inking mechanism of the printer head by the pump, surplus ink is discharged therefrom by the pump and is recovered. The ink discharging capacity is made larger than the ink supplying capacity so that the desired predetermined quantity of ink is maintained in the inking mechanism. Accordingly, ink and air are mixed in the ink discharging tube adapted to recover the ink as a result of which bubbles are created at the recovered ink receiving inlet of the ink tank and the bubbles thus created are collected in the ink tank.

An ink level detector for detecting the quantity of ink remaining in the tank is provided in the tank, and an air hole for allowing air to pass in and out of the ink tank is provided in the ink tank. If a large number of bubbles collect in the ink tank, the operation of the ink level detector will be obstructed thereby and the ink bubbles may overflow the air hole to foul the ink tank and the areas around the ink tank.

For instance, an ink level detector may be used which includes two electrodes arranged in the ink tank for detecting the level of the ink, utilizing variations of the resistance between the two electrodes. If the electrodes are shortcircuited by the ink bubbles collected in the tank, the resistance between the electrodes will be maintained unchanged even when the ink tank is emptied. That is, the resistance is equal to that detected when the ink remains in the ink tank. thus, if too great a quantity of ink bubbles is collected in the ink supply tank, it is impossible to detect the quantity of ink remaining in the ink tank.

The above-described difficulty is eliminated according to another aspect of the invention. Ink is provided such that collection of ink bubbles in the ink tank is prevented, thus permitting correct operation of the ink level detector. Overflow of the ink through the air hole of the ink tank is prevented.

Figure 19:
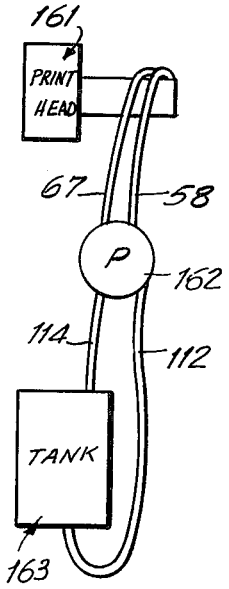
FIG. 19 is a flow diagram of an ink supplying device and a printer head coupled through a pump and ink supplying and discharging tubes.
Figure 20:
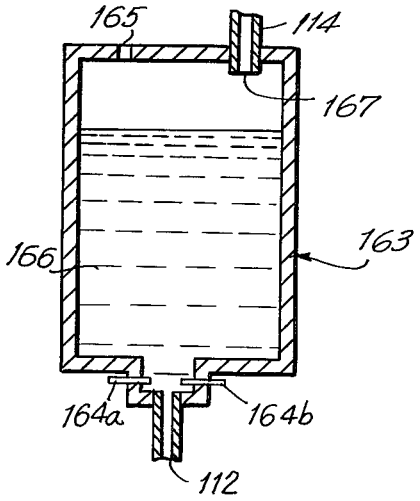
FIG. 20 is a sectional view of an ink tank employed with the dot printer of this invention.

FIG. 19 is a functional diagram showing an ink supplying device and a printer head which are coupled to each other. FIG. 20 is a sectional view of an exemplary ink storage tank.

In FIGS. 19 and 20, the device includes a printer head 161, a pump 162 for supplying ink to the printer head 161 and for discharging surplus ink therefrom, an ink tank 163, an ink supplying tube 112 connected between the pump 162 and the ink tank 163, an ink discharging tube 114 connected between the pump 62 and the ink tank 163, two electrodes **164*a*, 164*b* for detecting the quantity of ink remaining in the ink tank, an air hole 165 for allowing air to pass in and out of the ink tank, the ink 166, and a recovered ink receiving inlet 167**.

The electrodes **164*a*, 164*b* are disposed close to the bottom of the ink tank 163. The quantity of ink remaining in the tank is detected from the resistance between the electrodes. When ink is present between the electrodes 164*a*, 164*b***, the resistance between the electrodes typically ranges from several tens of kilohms to several hundreds of kilohms. When there is no ink between the electrodes, the electrodes are electrically insulated from each other. A conventional electrical circuit can be employed for displaying the presence or absence of ink in the tank according to the variations of the resistance between the electrodes. A description of such a known electrical circuit will be omitted here.

Since the ink discharging capacity is made larger than the ink supplying capacity in accordance with the invention, ink and air are mixed in the ink discharging tube as a result of which the ink bubbles are created at the recovered ink receiving inlet 167, as was described above.

The fluid ink of the conventional wire dot printer is prepared by mixing dye, a wetting agent such as aliphatic polyhydric alcohol and water. With these substances, the ink bubbles formed at the recovered ink receiving inlet 167 are very small in size and accordingly very few of them break. If the ink bubbles are left as they are, then the surface of the ink in the ink tank will be covered with ink bubbles. As the level of the ink is lowered, the level of the ink bubbles on the surface of the ink is also lowered. Finally, the electrodes will be coupled only through the ink bubbles. Thus, even when the ink is empty, the resistance between the electrodes will not change because of the presence of the ink bubbles. Accordingly, in this case, it is impossible to correctly detect the amount of ink remaining in the ink tank. If the space in the ink tank is fully occupied by the ink bubbles, then the ink bubbles will overflow the air hole 165 as a result of which not only the ink tank but also the parts around the ink tank will be fouled with ink.

In accordance with the invention, the above-described difficulties are eliminated by addition of a bubble suppressing agent to the ink by which the formation of ink bubbles at the recovered ink receiving inlet of the ink tank is suppressed and ink bubbles already created are quickly eliminated.

This aspect of the invention is here described with reference to specific examples:

EXAMPLE 1

Pure water, 59.9 parts by weight was put in a cleaned agitating tank. The water was subjected to magnetron agitation and the temperature of the water was gradually increased by a heater to about 40° C. While the water was being maintained at that temperature, dehydroacetic acid sodium, 0.1 part by weight, was gradually added thereto. After it was completely dissolved, triethylene glycol of 29 parts by weight and ethylene glycol of 6 parts by weight were added. The resultant solution was agitated for thirty minutes. Thereafter, Kayasetblue TM of 2 parts by weight and Sumilight Violet $BB_{conc}$ of 1 part by weight were gradually added, and the resultant solution was agitated for about two hours. After the solution was cooled, a bubble suppressing agent, product KM68-1F manufactured by Shinetsu Kagaku of Japan, in a quantity to provide a 0.2% aqueous solution was gradually added. The solution was agitated for more than thirty minutes. The solution was filtered with a five micron millipore filter. As a result, a fluid ink having the following composition was obtained for the wire dot printer.

Kayasetblue TM : 2 parts by weight
Sumilight Violet $BB_{conc}$: 1
Triethylene glycol: 29
Ethylene glycol: 6
KM68-1F 0.2% aqueous solution: 2
Dehydroacetic acid sodium: 0.1
Water: 59.9
Viscosity: 4.2 c.p. (20° C.)

Experiments were performed using the ink thus prepared in a wire dot printer using a fluid ink. As a result, it was found that the printing operation was carried out reliably and the resultant dot prints were uniform in density and high in quality. Furthermore, the number of ink bubbles created at the recovered ink receiving inlet was small and the ink bubbles which were created were relatively large so that they immediately break while dropping to the surface of the ink in the ink tank. Accordingly, the electrodes **164*a*,164*b* were never connected through the ink bubbles, and no ink bubbles overflowed the air hole 165. Thus, detection of the quantity of ink remaining in the ink tank was carried out satisfactorily. A fluid ink which is obtained by removing the bubble suppressing agent KM68-1F 0.2% aqueous solution from the composition described in Example 1 was prepared similarly as in Example 1. Experiments were performed using the ink prepared in the same printer. A number of small ink bubbles were formed at the recovered ink receiving inlet of the ink tank and were scarely broken. Accordingly, the electrodes 164*a*,164*b* were coupled through the ink bubbles to each other and detection of the amount of ink remaining in the tank was impossible. In addition, sometimes the ink bubbles overflowed the air hole 165** of the ink tank.

Next, the diameter of wires employed in the wire dot printer will be discussed. In order to eliminate the ink ribbon from a conventional printer, the aforementioned advantages can be fully utilized. In general, the diameters of wires employed in a wire dot head of this type range from about 0.3 mm to about 0.4 mm. In a multi-pin printer such as is employed in a word processor for the Japanese language, the wire diameter is of the order of about 0.3 mm to about 0.2 mm. Wires which have a smaller diameter than those mentioned above cannot be used as a practical matter due to the above-described reasons.

The inventors have discovered that, when printing is carried out with ink on the end face of the wire, as the diameter of the wire is increased, the quantity of ink which is scattered when the wire strikes the recording sheet is increased. This problem can be solved by suitably controlling the quantity of ink which is adhered to the wire end faces as described above. However, it is very difficult to solve the problem this way. Furthermore, it has been confirmed that the amount of splashing ink can be reduced by chamfering the wire end face or by making it spherical. The reason for this appears to be that, as the ink clinging to the wire end face tends toward a spherical shape, the quantity of the ink is substantially proportional to the third power of the wire diameter. Accordingly, as the wire diameter is increased, the amount of ink clinging to the wire end face is increased, as a result of which the amount of splashing ink is increased. As described above, with the structure of the invention, the amount of ink adhering to the wire end face is satisfactorily controlled. However, if the wire diameter is set in a range in which the characteristics of the wire dot head can be fully utilized, then the merits of the above-described structure can be more effectively realized. It has been found experimentally that, if the wire diameter is not larger than 0.2 mm, the amount of splashed ink is greatly reduced.

A variety of methods of improving the print quality of a wire dot printer have have been proposed in the art. In accordance with one of the methods, the quality of prints made by the printer is made similar to that of prints made of a matrix printer. It is well known that print quality can be improved by increasing the number of dots per unit area. Accordingly, a method has been proposed in which this technique is utilized wherein the quality of the print is improved by doubly striking the recording sheet with the wire dot head. However, since the wire diameter is limited as described above, it is impossible to print as fine a line as can be printed with a matrix print. In a multi-pin wire dot head using an ink ribbon, such as may be used in a word processor for the Japanese language, the wire diameter is of the order of 0.2 mm at the minimum and the number of pins used is typically twenty-four. If twelve wires are arranged in two lines in this wire dot head, the height of a printed character is of the order of 3.5 mm. Thus, this wire dot head suffers from certain limits in printing a character of low height but of desirably high quality.

As is apparent from the above description, it is substantially impossible using prior art technique in which the wire diameter is limited, to increase the print density and to print fine lines to thereby improve the print quality.

However, this drawback has been eliminated in accordance with this invention. For instance, if wires having a diameter of about 0.1 are used, according to the invention forty-eight dots can be printed in the size of a character printed by the conventional 24-pin wire dot head so that the print density is doubled. Furthermore, using this invention, the conventional 24-pin wire dot printer can be improved so that the height of a character can be decreased to increase the print density and yet the print quality is high.

With a 14-pin, 24-pin or 32-pin type wire dot head using wires 0.2 mm or smaller in diameter according to the invention, fine lines of characters or delicate characters can be printed with high quality. In addition, since the wire dot printer of the invention is of the hammer type, characters or the like can be printed in duplication. The configuration of the wire end face may be circular, triangular or elliptic or another desired shape.

With the inking mechanism of the invention as described above, even if the wires are reciprocated continuously at high speed, a suitable quantity of ink is reliably supplied to the printing end face of each wire at all times, and accordingly dot prints are made with high quality for long periods.

It will thus be seen that the objects set forth above, among those made apparent from the preceding description, are efficiently attained and, since certain changes may be made in the above constructions without departing from the spirit and scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described and all statements of the scope of the invention which, as a matter of language, might be said to fall therebetween.

What is claimed is:

1. A wire dot printer having a print head using a fluid ink in which printing is carried out with the ink adhering to the end faces at the end portions of printing wires for direct transfer of said adhering ink to a print medium upon impact therewith, comprising:

printing wires each having an end face;

means for selectively displacing said wires between an inking position and a printing position;

a front wire guide adapted to guide said end portions of said wires through openings in said front wire guide;

a rear wire guide positioned behind said front wire guide; and means for providing ink to an ink path, said ink path crossing said wires between said front wire guide and said rear wire guide at positions adjacent to the end faces of said wires, the space between said front and rear wire guides defining said ink path and being dimensioned for capillary flow therein at least in the region adjacent said wires, and further including an auxiliary wire guide provided on a front surface of said front wire guide and a holder adapted to hold said auxiliary wire guide, a space being formed between said holder and auxiliary wire guide to interrupt the flow of ink due to capillary action.

2. A wire dot printer having a print head using a fluid ink in which printing is carried out with the ink adhering to the end faces at the end portions of printing wires for direct transfer of said adhering ink to a print medium upon impact therewith, comprising:

printing wires each having an end face;

means for selectively displacing said wires between an inking position and a printing position;

a front wire guide adapted to guide said end portions of said wires through openings in said front wire guide, said front wire guide including partition walls separating the plurality of wire guide openings formed in said front wire guide, said partition walls having a fine ink path therein through which adjacent wire guide openings on both sides of said partition wall communicate with each other.

a rear wire guide positioned behind said front wire guide; and means for providing ink to an ink path, said ink path crossing said wires between said front wire guide and said rear wire guide at positions adjacent to the end faces of said wires, the space between said front and rear wire guides defining said ink path and being dimensioned for capillary flow therein at least in the region adjacent said wires.

3. A wire dot printer having a print head using a fluid ink in which printing is carried out with the ink adhering to the end faces at the end portions of printing wires for direct transfer of said adhering ink to a print medium upon impact therewith, comprising:

printing wires each having an end face;

means for selectively displacing said wires between an inking position and a printing position;

a front wire guide adapted to guide said end portions of said wires through openings in said front wire guide;

a rear wire guide positioned behind said front wire guide; and means for providing ink to an ink path, said ink path crossing said wires between said front wire guide and said rear wire guide at positions adjacent to the end faces of said wires, the space between said front and rear wire guides defining said ink path and being dimensioned for capillary flow therein at least in the region adjacent said wires, said means for providing ink including an ink supplying port for supplying said ink to said ink path and an ink discharging port for discharging surplus ink supplied through said ink supplying port, and an ink bypass communicating with said ink supplying port and said ink discharging port, said bypass being a parallel, ink flow channel with said ink path.

4. The wire dot printer as claimed in claim 3, wherein said ink path is so formed that ink in said path is pulled around said wires extending through said ink path by capillary action, and said openings in said front wire guide are dimensioned to define a capillary channel with each said wire to draw ink from said ink path to said printing wire end faces.

5. The wire dot printer as claimed in claim 3, and further comprising roughened surface in said ink path.

6. The wire dot printer as claimed in claim 3, wherein the dimension of the space defining said ink path between said front and rear wire guides is greater in a region spaced from said wires than in said region adjacent to said wires.

7. The wire dot printer as claimed in claim 3, wherein at least one wire array is provided, and said ink supplying port and said ink discharging port are arranged symmetrically of said at least one array of wires so that said ink supplying port and said ink discharging port are on opposite sides of said at least one array for ink flow perpendicularly to wires of said at least one array of wires.

8. The wire dot printer as claimed in claim 3, wherein said ink path and said ink bypass are formed with different flow areas so that ink flows more readily in said ink bypass than in said ink path.

9. The wire dot printer as claimed in claim 3 and further comprising a second bypass communicating with said ink supplying port and said ink discharging port and being a parallel flow channel with said ink path, and wherein said ink bypasses surround and are in communication with the periphery of said ink path.

10. The wire dot printer as claimed in claim 9, wherein said ink bypasses have an ink flow resistance determined by the contours of said bypasses, said resistance determining the quantity of ink flowing into said ink path so that said ink is applied essentially equally to said wires, said ink path and said ink bypasses being formed with different flow areas so that said ink flows more readily in said ink bypasses than in said ink path.

11. The wire dot printer as claimed in claim 10, wherein said means to provide ink further includes a wall in a flow path communicating with said ink path, said ink bypasses and said ink supplying port, said ink flowing into said ink bypasses and said ink path after striking against said wall.

12. The wire dot printer as claimed in claim 3, wherein a main flow of ink flowing through said ink supplying port is diverted from flowing directly into said ink path by allowing said main flow to flow into said ink bypass whereby dynamic pressure in said main flow, if any, is relieved.

13. The wire dot printer as claimed in claim 3 and further comprising a splashed ink recovering plate provided behind said ink path with a space between said splashed ink recovering plate and said ink path.

14. The wire dot printer as claimed in claim 13, wherein said splashed ink recovering plate is made of a porous material.

15. The wire dot printer as claimed in claim 3, wherein said rear wire guide is provided with opening means through which said printing wires extend, said opening means communicating with said ink path, said printer including ink recovering path means including said opening means interconnecting said ink path and said ink discharging port for recovering surplus ink flowing to the printing wires.

16. The wire dot printer as claimed in claim 15, wherein the cross-sectional area of said opening means in said rear wire guide is greater than the cross-sectional area of said openings in said front wire guide.

17. The wire dot printer as claimed in claim 3, wherein the clearance between said rear wire guide and each wire is larger than the clearance between said front wire guide and each wire.

18. The wire dot printer as claimed in claim 3, and further comprising a bearing member made of a durable bearing material for guiding end portions of said wires adjacent said printing end faces of said wires, said bearing member being seated on a portion of said front wire guide, and the clearance between said rear wire guide and each wire being larger than the clearance between said front wire guide having said bearing member and each wire.

19. The wire dot printer as claimed in claim 18, wherein said bearing member is secured to said wire guide without any path for supplying ink to the ends of said wires being formed, with the exception of said clearance between said bearing member and each said wire.

20. A wire dot printer having a print head using a fluid ink in which printing is carried out with the ink adhering to end faces at the end portions of wires comprising:

a front wire guide adapted to guide said end portions of said wires adjacent said printing end faces of said wires;

a rear wire guide opposing said front wire guide, said wires passing through openings in said guides;

an ink path for providing a capillary force, said ink path being formed between said front wire guide and said rear wire guide, said ink path crossing said wires;

an ink recovering plate forming a capillary path with the rear of said rear wire guide, a space being provided between said ink recovering plate and said rear wire guide in the region between the capillary path and the wires, said space being larger in the region adjacent said ink recovering plate than in the region adjacent the front of the rear wire guide, said space communicating with said ink path through said opening in said rear wire guide,;

an ink supplying port for supplying said ink to said ink path; and an ink discharging port for discharging surplus ink supplied through said ink supplying port and communicating with said ink path and further communicating with said capillary path for receiving surplus ink therefrom.

21. The wire dot printer as claimed in claim 20, wherein a plurality of grooves are formed in and extend along a surface of said front wire guide on the side of said printing end faces of said wires, said grooves being transverse to said wires.

22. The wire dot printer as claimed in claim 21, wherein at least a portion of said grooves communicate with said wire openings in said front wire guide.

23. The wire dot printer as claimed in claim 21, wherein in each of said plurality of grooves the upper crosssectional dimension thereof is larger than the lower crosssectional dimension thereof.

24. The wire dot printer as claimed in claim 3 or 20, wherein, at standby, said printing end faces of said wires are positioned retracted from a top end surface of said print head.

25. The wire dot printer as claimed in claim 21, wherein said printing end faces of said wires are positioned in said grooves.

26. The wire dot printer as claimed in claim 20, and further comprising an auxiliary wire guide provided on a front surface of said front wire guide.

27. The wire dot printer as claimed in claim 26, wherein said auxiliary wire guide is movable with respect to said front wire guide.

28. The wire dot printer as claimed in claim 26, wherein said auxiliary wire guide comprises a plurality of stacked auxiliary wire guide members.

29. The wire dot printer as claimed in claim 26, wherein said auxiliary wire guide has grooves in a surface thereof, and at least one thin additional guide is provided on said auxiliary wire guide on the rear side of said grooves.

30. The wire dot printer as claimed in claim 26, and further comprising a holder adapted to hold said wire guide, a space being formed between said holder and auxiliary wire guide to interrupt the flow of ink due to capillary action.

31. The wire dot printer as claimed in claim 20, wherein partition walls separate the plurality of wire guide openings formed in said front wire guide, said partition walls having a fine ink path therein through which adjacent wire guide openings on both sides of said partition wall communicate with each other.

32. A wire dot printer as claimed in claim 20, wherein said front wire guide is formed with openings through which said wires pass, said openings being dimensioned to define a further capillary path between the front wire guide and the wires for drawing the ink to the end faces of the wires, said rear wire guide being formed with opening means communicating between said space and said ink path, the cross-sectional area of said opening means being greater than the cross-sectional area of said openings in said front wire guide.

33. A wire dot printer having a print head using a fluid ink and an inking mechanism in which printing is carried out with the ink adhered to the printing end faces at the end portions of wires comprising:

a front wire guide adapted to guide said end portions of said wires adjacent said printing end faces of said wires;

a rear wire guide provided behind said front wire guide, said front wire guide and said rear wire guide forming an ink path therebetween said ink path crossing said wires;

an inking mechanism for supplying ink to said printing end faces;

an ink supplying port for supplying ink to said inking mechanism;

an ink discharging port for discharging surplus ink supplied through said ink supplying port; and a pump, said ink being supplied through said ink supplying port by said pump and being discharged through said ink discharging port by said pump, the pump capacity for discharging ink from said inking mechanism being larger than the pump capacity for supplying ink to said inking mechanism.

34. The wire dot printer as claimed in claim 33, wherein said pump comprises means for providing a valve action which, when said pump is stopped, interrupts the flow of ink through said pump.

35. The wire dot printer as claimed in claim 33, wherein said pump comprises:

a central shaft;

a rotary plate rotatable around said central shaft;

a plurality of rollers rotatably supported on a circumference of said rotary plate, said circumference being coaxial with said central shaft;

a housing having arcuate guides along the locus of revolution of said plurality of rollers; and an ink supplying elastic tube and an ink discharging elastic tube, said elastic tubes being disposed between said housing and said rollers.

36. The wire dot printer claimed in claim 35, wherein the inside diameter of said ink discharging elastic tube is larger than the inside diameter of said ink supplying elastic tube.

37. The wire dot printer as claimed in claim 35, wherein said housing is subject to separation into two housing parts, said parts being adapted to hold therebetween a roller assembly comprising said plurality of rollers which revolve on said plate around said central shaft.

38. The wire dot printer as claimed in claim 37, wherein said pump further comprises an elastic member, said two housing parts being depressed against said roller assembly by said elastic member in such a manner that said two housing parts hold said roller assembly therebetween to depress said elastic tubes.

39. The wire dot printer as claimed in claim 35, wherein said plurality of rollers comprises both elastic tube depressing rollers and elastic tube relieving rollers which are arranged alternately around said plate.

40. The wire dot printer as claimed in claim 35, and further comprising tubes forming ink flow paths outside said pump, said flow paths being made of a material having a lower moisture permeability than that of said elastic tubes inside said pump.

41. The wire dot printer as claimed in claim 35, wherein the material of said elastic tubes inside said pump is silicone rubber, and further comprising tubes forming ink flow paths outside said pump made of a material having a moisture permeability of not more than 30 $g/m^2$, 24 h.

42. A wire dot printer having a print head using a fluid ink in which printing is carried out with the ink adhering to the end faces at the end portions of printing wires for direct transfer of said adhering ink to a print medium upon impact therewith, comprising:

printing wires each having an end face;

wire guide means adapted to guide said end portions of said wires through openings in said wire guide means;

means for applying ink to the end faces of the printing wires from within said wire guide means;

said wire guide means being provided with a plurality of grooves formed in and extending along a surface of said wire guide means on the side of said printing end faces of said printing wires, said grooves extending transverse to said printing wires and at least a portion of said grooves intersecting said openings.

43. The wire dot printer as claimed in claim 42, wherein each of said grooves is dimensioned so that the upper cross-sectional dimension thereof is larger than the lower cross-sectional dimension thereof.

44. A wire dot printer having a print head using a fluid ink in which printing is carried out with the ink adhering to the end faces at the end portions of printing wires for direct transfer of said adhering ink to a print medium upon impact therewith, comprising:

printing wires each having an end face;

means for selectively displacing said wires between an inking position and a printing position;

a front wire guide adapted to guide said end portions of said wires through openings in said front wire guide;

a rear wire guide positioned behind said front wire guide; and means for providing ink to an ink path, said ink path crossing said wires between said front wire guide and said rear wire guide at positions adjacent to the end faces of said wires, the space between said front and rear wire guides defining said ink path and being dimensioned for capillary flow therein at least in the region adjacent said wires, and further including a plurality of grooves formed in and extending along a surface of said front wire guide on the side of said printing end faces of said wires, said grooves being transversed to said wires.

45. The wire dot printer as claimed in claim 44, wherein at least a portion of said grooves communicate with said wire openings in said front wire guide.

46. The wire dot printer as claimed in 44, wherein in each of said plurality of grooves the upper cross-sectional dimension thereof is larger than the lower cross-sectional dimension thereof.

47. A wire dot printer having a print head using a fluid ink in which printing is carried out with the ink adhering to the end faces at the end portions of printing wires for direct transfer of said adhering ink to a print medium upon impact therewith, comprising:

printing wires each having an end face;

means for selectively displacing said wires between an inking position and a printing position;

a front wire guide adapted to guide said end portions of said wires through openings in said front wire guide;

a rear wire guide positioned behind said front wire guide; and means for providing ink to an ink path, said ink path crossing said wires between said front wire guide and said rear wire guide at positions adjacent to the end faces of said wires, the space between said front and rear wire guides defining said ink path and being dimensioned for capillary flow therein at least in the region adjacent said wires, and further including an auxiliary wire guide provided on a front surface of said front wire guide, said auxiliary wire guide being movable with respect to said front wire guide.

48. A wire dot printer having a print head using a fluid ink in which printing is carried out with the ink adhering to the end faces at the end portions of printing wires for direct transfer of said adhering ink to a print medium upon impact therewith, comprising:

printing wires each having an end face;

means for selectively displacing said wires between an inking position and a printing position;

a front wire guide adapted to guide said end portions of said wires through openings in said front wire guide;

a rear wire guide positioned behind said front wire guide; and means for providing ink to an ink path, said ink path crossing said wires between said front wire guide and said rear wire guide at positions adjacent to the end faces of said wires, the space between said front and rear wire guides defining said ink path and being dimensioned for capillary flow therein at least in the region adjacent said wires, and further including an auxiliary wire guide provided on a front surface of said front wire guide, said auxiliary wire guide comprising a plurality of stacked auxiliary wire guide members.

49. A wire dot printer having a print head using a fluid ink in which printing is carried out with the ink adhering to the end faces at the end portions of printing wires for direct transfer of said adhering ink to a print medium upon impact therewith, comprising:

printing wires each having an end face;

means for selectively displacing said wires between an inking position and a printing position;

a front wire guide adapted to guide said end portions of said wires through openings in said front wire guide;

a rear wire guide positioned behind said front wire guide; and means for providing ink to an ink path, said ink path crossing said wires between said front wire guide and said rear wire guide at positions adjacent to the end faces of said wires, the space between said front and rear wire guides defining said ink path and being dimensioned for capillary flow therein at least in the region adjacent said wires, and further including an auxiliary wire guide provided on a front surface of said front wire guide, said auxiliary wire guide having grooves in a surface thereof, and at least one thin additional guide being provided on said auxiliary wire guide on the rear side of said grooves.

50. A wire dot printer having a print head using a fluid ink in which printing is carried out with the ink adhering to the end faces at the end portions of wires for direct transfer of said adhering ink to a print medium upon impact therewith, comprising:

printing wires each having an end face;

means for selectively displacing said wire between an inking position and a printing position;

wire guide means formed with opening means for receipt of said wires;

means for providing ink including an ink supplying port, an ink discharging port and an ink path for the flow of ink through said ink path between said ports;

said wire guide means being formed with a passage therethrough at least in part intersecting said opening means, to define at least a portion of said ink path, said passage including an enlarged bypass region connecting said ports and a capillary region between said enlarged bypass region and said opening means for drawing ink from said enlarged bypass region to said opening means said bypass region of said passage being spaced from said opening means, said opening means being dimensioned to define a capillary channel with each said wire to draw ink from said ink path to said printing wire end face when said printing wire is at its inking position.

51. The wire dot printer as claimed in claim 50, wherein said ink port is free of wicking material, at least in the region adjacent said wires.

52. The wire dot printer as claimed in claim 50, wherein said enlarged region of said ink path reservoir essentially surrounds said capillary region which essentially surrounds said opening means.

53. The wire dot printer as claimed in claim 50, wherein said wires include at least one array of side-by-side-aligned wires, said ink supply port being positioned on one side of said wires essentially centrally of said array, said ink discharge port being positioned on the opposite side of said wires essentially centrally of said array, said enlarged bypass region of said ink path essentially surrounding said capillary region which essentially surrounds said opening means, whereby ink may be fed to said opening means essentially along an entire circumferential region of said opening means.

54. The wire dot printer as claimed in claim 50, wherein said ink providing means includes a main reservoir, ink carrying means connecting said main reservoir and said ports, and pump means coupled to said ink carrying means for pumping ink through said ink path.

55. The wire dot printer as claimed in claim 50, wherein said wire guide means includes a front wire guide including said first-mentioned opening means and a rear wire guide positioned adjacent to and behind said front wire guide and formed with second opening means through which said wires extend, facing surfaces of said front and rear wire guides being shaped to define said enlarged and capillary regions of said ink path therebetween.

56. The wire dot printer as claimed in claim 55, wherein at least the surface of one of said front and rear wire guides defining said capillary region is formed with grooves extending from said enlarged region to the associated opening means.

57. The wire dot printer as claimed in claim 55, wherein at least the surface of one of said front and rear wire guides defining said capillary region is roughened.

58. The wire dot printer as claimed in claim 55, wherein said second opening means is a single opening through which said wires extend.

59. The wire dot printer as claimed in claim 55, wherein said second opening means is of a greater cross-sectional area than said first mentioned opening means and said rear wire guide means being formed with ink recovery path means coupling said second opening means at a point spaced from said capillary region and said ink discharging port for carrying away excess ink.

60. The wire dot printer as claimed in claim 59, wherein said ink recovery path means is formed with an enlarged region of said second opening means surrounding said wires at a point spaced from said capillary region, a splashed ink recovery plate having an opening therethrough for the passage of the wires, in part enclosing said enlarged region of said second opening means and defining with said rear wire guide a capillary channel leading from said enlarged section of said second opening means forming a part of said ink recovery path means.

61. The wire dot printer as claimed in claim 60, wherein said splashed ink recovery plate is made of a porous material.

62. The wire dot printer as claimed in claim 60, wherein said second opening means is a single opening through which said wires extend.

63. The wire dot printer as claimed in claim 50, including a wall in said ink path between said ink supplying port and said enlarged bypass region of said ink path, said ink flowing into said enlarged region of said ink path after striking against said wall.

64. A wire dot printer having a print head using a fluid ink in which printing is carried out with the ink adhering to the end faces at the end portions of printing wires for direct transfer of said adhering ink to a print medium upon impact therewith, comprising:

printing wires each having an end face;

means for selectively displacing said wires between an inking position and a printing position;

a front wire guide adapted to guide said end portions of said wires through openings in said front wire guide;

a rear wire guide positioned behind said front wire guide; and means for providing ink to an ink path, said ink path crossing said wires between said front wire guide and said rear wire guide at positions adjacent to the end faces of said wires, the space between said front and rear wire guides defining said ink path and being dimensioned for capillary flow therein at least in the region adjacent said wires, and further including a grooved surface provided in said ink path for holding ink adjacent said end portions.

65. The wire dot printer as claimed in claims 3, 64, 20, 33, 50, 42 or 44, wherein said wires have a diameter of not more than 0.2 mm.

66. The wire dot printer as claimed in claims 3, 64, 20, 33, 50, 42 or 44, wherein said end faces of said printing wires are spherical.

67. The wire dot printer as claimed in claims 3, 64, 20, 33, 50, 42 or 44, wherein said end faces of said printing wires are chamfered.

* * * * *